US006924783B2

(12) United States Patent
Johnson et al.

(10) Patent No.: US 6,924,783 B2
(45) Date of Patent: Aug. 2, 2005

(54) DRIVE SCHEME FOR CHOLESTERIC LIQUID CRYSTAL DISPLAYS

(75) Inventors: David M. Johnson, Rochester, NY (US); Xiang-Dong Mi, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 361 days.

(21) Appl. No.: 10/352,562

(22) Filed: Jan. 28, 2003

(65) Prior Publication Data

US 2004/0145549 A1 Jul. 29, 2004

(51) Int. Cl.[7] ..... G09G 3/36
(52) U.S. Cl. ..... 345/94; 345/99
(58) Field of Search ..... 345/87, 94, 95, 345/99, 98, 100, 212, 213, 208

(56) References Cited

U.S. PATENT DOCUMENTS

| | | | | |
|---|---|---|---|---|
| 5,251,048 | A | | 10/1993 | Doane et al. |
| 5,437,811 | A | | 8/1995 | Doane et al. |
| 5,592,190 | A | * | 1/1997 | Okada et al. ..... 345/89 |
| 5,644,330 | A | | 7/1997 | Catchpole et al. |
| 5,695,682 | A | | 12/1997 | Doane et al. |
| 5,703,615 | A | * | 12/1997 | Usami ..... 345/97 |
| 5,748,277 | A | * | 5/1998 | Huang et al. ..... 349/169 |
| 5,838,293 | A | * | 11/1998 | Kondoh ..... 345/97 |
| 6,154,190 | A | | 11/2000 | Yang et al. |
| 6,268,840 | B1 | | 7/2001 | Huang |

FOREIGN PATENT DOCUMENTS

| | | | |
|---|---|---|---|
| EP | 1 258 860 | A1 | 11/2002 |
| WO | 98/50804 | | 4/1999 |

OTHER PUBLICATIONS

Kozachenko et al., Hysteresis as a Key Factor for the Fast Control of Reflectivity in Cholesteric LCDs, *Conference Record of the IDRC 1997*, pp. 148–151.

Sorokin, Simple Driving Methods for Cholesteric Reflective LCDs, *Asia Display*, 1998, pp. 749–752.

Rybalochka et al., Dynamic Drive Scheme for Fast Addressing of Cholesteric Displays, *SID 00 Digest*, pp. 818–821.

Rybalochka et al., Simple Drive Scheme for Bistable Cholesteric LCDs, *SID 01 Digest*, pp. 882–885.

U.S. Appl. No. 09/723,389, filed by Johnson et al., Nov. 28, 2000.

U.S. Appl. No. 09/851,868 filed by Stephenson et al., May 9, 2001.

U.S. Appl. No. 09/923,659, filed by Mi et al., Aug. 7, 2001.

* cited by examiner

*Primary Examiner*—Kent Chang
(74) *Attorney, Agent, or Firm*—Kathleen Neuner Manne

(57) ABSTRACT

In a drive scheme for driving the pixels of a passive matrix liquid crystal display having row and column electrodes, the drive scheme including a selection step, the selection step including applying row and column waveforms to the display to generate selected pixel voltage pulses in a selected row and to generate non selected pixel voltage pulses in non selected rows, the selection step having an effective selection time that depends on the preceding and following nonselected pixel voltages, a framing voltage pulse is inserted between each successive selected pixel voltage pulse such that the effective selection time is independent of the preceding and following nonselected pixel voltages, whereby data pattern dependent defects in a displayed image are eliminated.

15 Claims, 20 Drawing Sheets

DRIVE SCHEME FOR CHOLESTERIC LIQUID CRYSTAL DISPLAYS

FIELD OF THE INVENTION

The present invention relates to cholesteric (chiral nematic) liquid crystal displays and their electrical drive schemes, and more particularly to such a drive scheme which eliminates data dependent defects.

BACKGROUND OF THE INVENTION

U.S. Pat. No. 5,437,811 issued Aug. 1, 1995 to Doane et al. discloses a light-modulating cell having a chiral nematic liquid crystal (cholesteric liquid crystal) in polymeric domains contained by conventional patterned glass substrates. The chiral nematic liquid crystal has the property of being driven between a planar state reflecting a specific visible wavelength of light and a light scattering focal conic state. Chiral nematic material has two stable states and can maintain one of the stable states in the absence of an electric field.

U.S. Pat. No. 5,251,048 issued Oct. 5, 1993 to Doane et al., and U.S. Pat. No. 5,644,330 issued Jul. 1, 1997 to Catchpole et al. disclose various driving methods to switch chiral nematic materials between its stable states. However, the update rate of these displays is far too slow for most practical applications. Typically, the update rate was about 10–40 milliseconds per line. It would take a 10–40 seconds to update a 1000 line display.

U.S. Pat. No. 5,748,277 issued May 5, 1998 to Huang et al., and U.S. Pat. No. 6,154,190 issued Nov. 28, 2000 to Yang et al. disclose fast driving schemes for chiral nematic displays, which are called dynamic drive schemes. The dynamic drive schemes generally comprise a preparation step, a pre-holding step, a selection step, a post-holding step, and an evolution step. These fast driving schemes require very complicated electronic driving circuitry. For example, all column and row drivers must output bi-polar and multiple level voltages. During the image writing, due to a pipeline algorithm used with the drive schemes, there is an undesirable black bar shifting over the frame.

U.S. Pat. No. 6,268,840 B1 issued Jul. 31, 2001 to Huang, discloses a unipolar waveform drive method to implement the above-mentioned dynamic driving schemes. However, because the amplitude of voltages required in the preparation step, the selection step, and the evolution step are distinct, both column and row drivers are required to generate multilevel unipolar voltages, which is still undesirable.

Kozachenko et al. (Hysteresis as a Key Factor for the Fast Control of Reflectivity in Cholesteric LCDs, Conference Record of the IDRC 1997, pp. 148–151), Sorokin (Simple Driving Methods for Cholesteric Reflective LCDs, Asia Displays 1998, pp. 749–752), and Rybalochka et al. (Dynamic Drive Scheme for Fast Addressing of Cholesteric Displays, SID 2000, pp. 818–821; Simple Drive scheme for Bistable Cholesteric LCDs, SID 2001, pp. 882–885) proposed so called $U/\sqrt{2}$ and $U/\sqrt{3/2}$ dynamic drive schemes requiring only 2-level column and row drivers, which output either U or 0 voltage. These drive schemes do not produce undesirable black shifting bars, instead, they cause the entire frame to go black during the writing. However, as their names suggest, they can be applied only to those cholesteric liquid crystal displays with very specific electro-optical properties, such as $U_{holding}=U_{evolution}=U/\sqrt{2}$ for the $U/\sqrt{2}$ dynamic drive scheme, or $U_{holding}=U_{evolution}=U/\sqrt{3/2}$ for the $U/\sqrt{3/2}$ dynamic drive scheme, where $U_{holding}$ and $U_{evolution}$ are effective voltages (root mean square voltages) of their holding step and evolution step, respectively. Because of this limit, many cholesteric liquid crystal displays either cannot be driven by these schemes, or can be driven only by compromising contrast and brightness.

Another problem with these drive schemes is data pattern dependent defects. Namely, the effective selection time varies depending on the nonselected pixel voltages preceding and following a selected row, thus the reflective state of a pixel changes in an undesired way. There is a need therefore for an improved dynamic drive scheme that eliminates data pattern dependent defects in a displayed image.

SUMMARY OF THE INVENTION

The need is met according to the present invention by providing a drive scheme for driving the pixels of a passive matrix liquid crystal display having row and column electrodes, the drive scheme including a selection step, the selection step including applying row and column waveforms to the display to generate selected pixel voltage pulses in a selected row and to generate non selected pixel voltage pulses in non selected rows, the selection step having an effective selection time that depends on the preceding and following nonselected pixel voltages, wherein a framing voltage pulse is inserted between each successive selected pixel voltage pulse such that the effective selection time is independent of the preceding and following nonselected pixel voltages, whereby data pattern dependent defects in a displayed image are eliminated.

ADVANTAGES

The drive scheme of the present invention has the advantage that it produces a uniform display state for each pixel in the display independent of the display state of neighboring pixels. The present invention has the further advantage that it can be applied to a variety of dynamic drive schemes including the $U/\sqrt{2}$ and $U/\sqrt{3/2}$ dynamic drive schemes and a variety of other fast drive schemes known in the art.

DETAILED DESCRIPTION OF THE INVENTION

Figure 1:
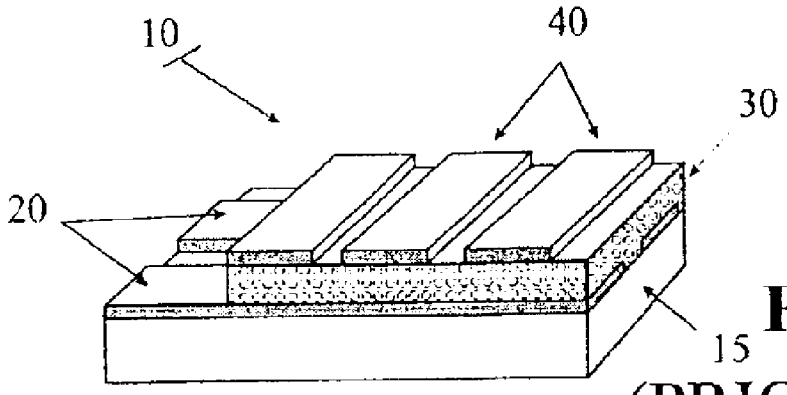
FIG. 1 (PRIOR ART)
FIG. 1 is a partial perspective view of a prior art cholesteric liquid crystal display.

FIG. 1 is partial perspective view of a structure for a prior art display 10 that can be driven in accordance with the invention. Display 10 includes a flexible substrate 15, which is a thin transparent polymeric material, such as Kodak Estar™ film base formed of polyester plastic that has a thickness of between 20 and 200 microns. A substrate 15 can be a 125 micron thick sheet of polyester film base. Other polymers, such as transparent polycarbonate, can also be used.

Electrodes in the form of first patterned conductors 20 are formed over substrate 15. First patterned conductors 20 can be tin-oxide or indium-tin-oxide (ITO), with ITO being the preferred material. Typically, the material of first patterned conductors 20 is sputtered as a layer over substrate 15 having a resistance of less than 250 ohms per square. The layer is then patterned to form first patterned conductors 20 in any well known manner. Alternatively, first patterned conductors 20 can be an opaque electrical conductor material such as copper, aluminum, or nickel. If first patterned conductors 20 are opaque metal, the metal can be oxidized to create light absorbing first patterned conductors 20. First patterned conductors 20 are formed in the conductive layer by conventional photolithographic or laser etching means.

A light modulating material such as a polymer dispersed cholesteric layer 30 overlays first patterned conductors 20. In a preferred embodiment, the polymer dispersed cholesteric layer 30 includes a polymeric host material and dispersed cholesteric liquid crystal materials, such as those disclosed in U.S. Pat. No. 5,695,682 issued Dec. 9, 1997 to Doane et al., the disclosure of which is incorporated by reference. Application of electrical fields of various amplitude and duration can drive a chiral nematic material into a reflective state, a transmissive state, or an intermediate state. These cholesteric materials have the advantage of maintaining a given state indefinitely after the field is removed. Cholesteric liquid crystal materials can be Merck BL112, BL118 or BL126, available from E.M. Industries of Hawthorne, N.Y.

The polymeric host material is provided by E.M. Industries cholesteric material BL-118 dispersed in deionized photographic gelatin. The liquid crystal material is dispersed at 8% concentration in a 5% deionized gelatin aqueous solution. The mixture is dispersed to create 10 micron diameter domains of the liquid crystal in aqueous suspension. The material is coated over a patterned ITO polyester sheet to provide a 7 micron thick polymer dispersed cholesteric coating. Other organic binders such as polyvinyl alcohol (PVA) or polyethylene oxide (PEO) can be used. Such compounds are machine coatable on equipment associated with photographic films.

Electrodes in the form of second patterned conductors 40 overlay polymer dispersed cholesteric layer 30. Second patterned conductors 40 should have sufficient conductivity to establish an electric field across polymer dispersed cholesteric layer 30. Second patterned conductors 40 can be formed in a vacuum environment using materials such as aluminum, silver, platinum, carbon, tungsten, molybdenum, tin, or indium or combinations thereof. The second patterned conductors 40 are as shown in the form of a deposited layer. Oxides of the metals can be used to darken second patterned conductors 40. The metal material can be oxidized by applying energy from resistance heating, cathodic arc, electron beam, sputtering, or magnetron excitation. Tin-oxide or indium-tin-oxide coatings permit second patterned conductors 40 to be transparent. Electrodes 20 and 40 are on opposite sides of the layer 30 and are in rows and columns, respectively, so that the intersection of a row and column defines pixels for applying an electric field at each intersection across the layer 30 when a voltage is applied to the electrodes.

Second patterned conductors 40 are printed conductive ink such as Electrodag 423SS screen printable electrical conductive material from Acheson Corporation. Such printed materials are finely divided graphite particles in a thermoplastic resin. The second patterned conductors 40 are formed using the printed inks to reduce display cost. The use of a flexible support for substrate 15, laser etching to form first patterned conductors 20, machine coating polymer dispersed cholesteric layer 30 and printing second patterned conductors 40 permits the fabrication of very low cost memory displays. Small displays formed using these methods can be used as electronically rewritable tags for inexpensive, limited rewrite applications.

Figure 2A:
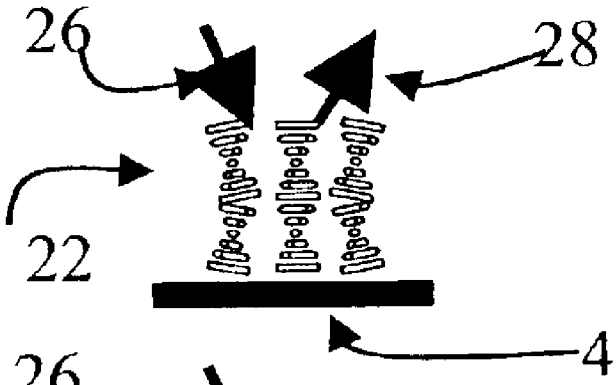
FIG. 2A (PRIOR ART)
FIG. 2A is a schematic diagram of a prior art cholesteric liquid crystal material in a planar state reflecting light.
Figure 2B:
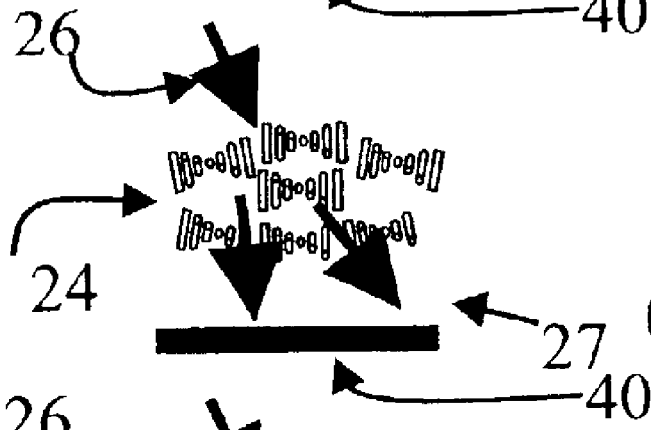
FIG. 2B (PRIOR ART)
FIG. 2B is a schematic diagram of a prior art cholesteric liquid crystal material in a focal conic state forward scattering light.
Figure 2C:
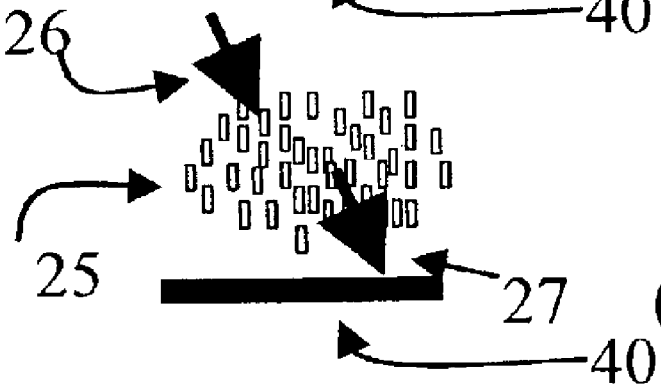
FIG. 2C (PRIOR ART)
FIG. 2C is a schematic diagram of a prior art cholesteric liquid crystal material in a homeotropic state transmitting light.

FIGS. 2A and 2B show two stable states of cholesteric liquid crystals. In FIG. 2A, a high voltage field has been applied and quickly switched to zero potential, which converts cholesteric liquid crystal to a planar state 22. Incident light 26 with proper wavelength and polarization striking cholesteric liquid crystal in planar state 22 is reflected as reflected light 28 to create a bright image. In FIG. 2B, application of a lower voltage field leaves cholesteric liquid crystal in a transparent focal conic state 24. Incident light 26 striking a cholesteric liquid crystal in focal conic state 24 is mainly forward scattered. Second patterned conductors 40 can be black which absorbs transmitted light 27 to create a dark image when the liquid crystal material is in focal conic state 24. As a result, a viewer perceives a bright or dark image depending if the cholesteric material is in planar state 22 or focal conic state 24, respectively. The cholesteric liquid crystal material also has a plurality of reflective states when a part of the cholesteric material is in planar state 22 and the rest is in focal conic state 24. Consequently, a viewer also perceives gray level images. In FIG. 2C, cholesteric liquid crystal is in a homeotropic state 25 when a high voltage is applied. Incident light 26 illuminating a cholesteric liquid crystal in homeotropic state 25 is transmitted.

Figure 2D:
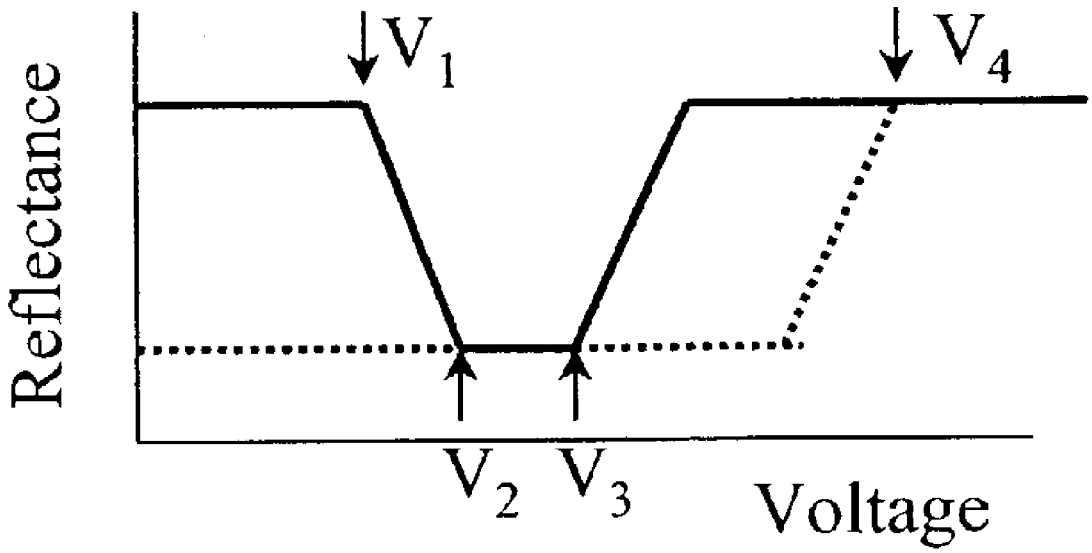
FIG. 2D (PRIOR ART)
FIG. 2D is a plot of the typical response of reflectance of a prior art cholesteric liquid crystal material to a pulsed voltage.

FIG. 2D illustrates the state of the liquid crystal material after the application of various driving voltages thereto. This figure generally corresponds to FIG. 1 of U.S. Pat. No. 5,644,330, referenced above. The liquid crystal material in layer 30 begins in a first state, either the reflecting planar state 22 shown in FIG. 2A or the non-reflecting focal conic state 24 shown in FIG. 2B, and is driven with an AC voltage, having an RMS (root mean square) amplitude above V4 in FIG. 2D. When the voltage is removed quickly, the liquid crystal material switches to the reflecting state and will remain reflecting. If driven with an AC voltage between V2 and V3, the material will switch into the non-reflecting state and remain so until the application of a second driving voltage. If no voltage is applied, or the voltage is well below V1, then the material will not change state, regardless of the initial state.

The prior art $U/\sqrt{2}$ dynamic driving scheme proposed by Rybalochka et al., referenced above, includes a preparation step and a pre-holding step prior to the selection step and a post-holding step and an evolution step following the selection step. The preparation step and the evolution step are common to all rows and independent of data pattern. However, the voltage pulses in the pre-holding step and the post-holding step vary with data pattern. For a given pixel formed by a particular pair of row and column electrodes, the pixel's final state depends on distinctive voltage pulses in the selection step. However, the voltage pulses (or waveforms) vary slightly in the pre-holding step and post-holding step depending on the data pattern applied to the column electrodes.

For conventional drive schemes as disclosed in U.S. Pat. Nos. 5,251,048 and 5,644,330, referenced above, the selection time is relatively long, for example 10 to 40 ms and the variation in the pre-selection and post-selection steps do not have much effect on the reflection of the final states. On the contrary, for all high speed drive schemes, the selection time is relatively short, in most cases, less than 1 ms, which is comparable with commonly used period of a voltage waveform (1 ms). Consequently, any variation immediately before and after the selection step has significant impact on the reflection of the final states.

Figure 3:
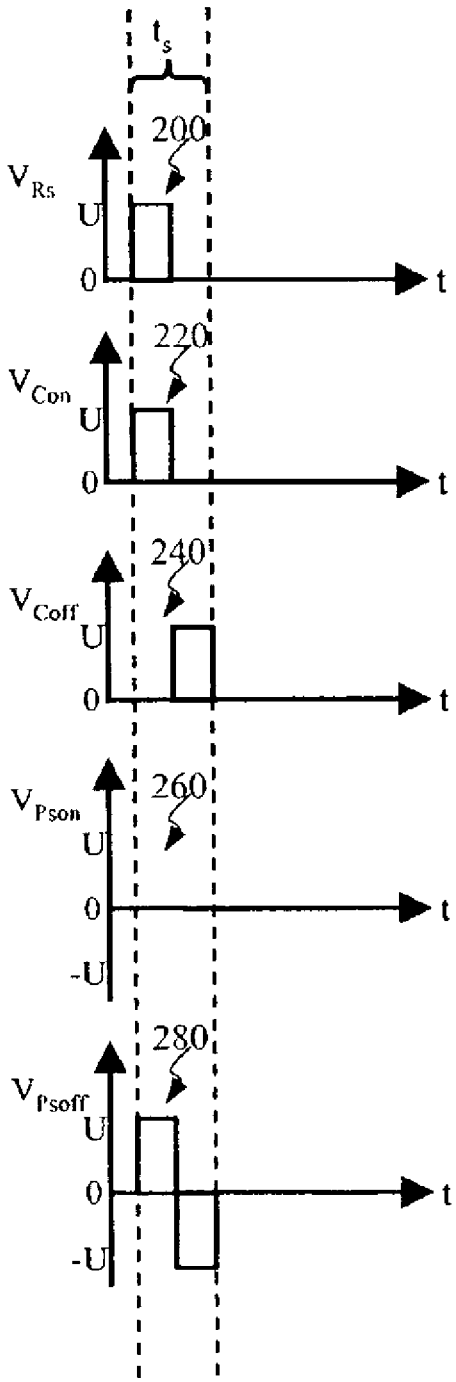
FIG. 3 (PRIOR ART)
FIG. 3 is a schematic diagram showing column voltage, row voltage, and pixel voltage pulses on selected rows in a prior art $U/\sqrt{2}$ dynamic drive scheme.
Figure 4:
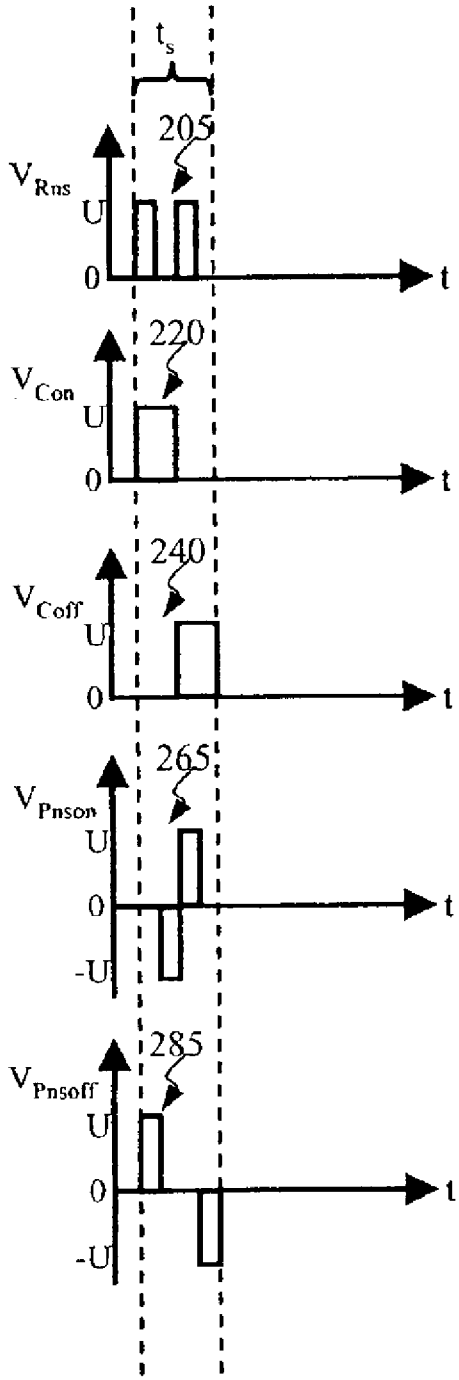
FIG. 4 (PRIOR ART)
FIG. 4 is a schematic diagram showing column voltage, row voltage, and pixel voltage pulses on non-selected rows in a prior art $U/\sqrt{2}$ dynamic drive scheme.

To better understand the data dependent defects, references are made to FIGS. 3 and 4, which are detailed descriptions of the selection step according to the prior art $U/\sqrt{2}$ dynamic driving scheme. To select a row, a selected row voltage pulse $V_{Rs}$ 200 is applied during a selection time $t_S$. For other non-selected rows, a non-selected row voltage pulse $V_{Rns}$ 205 is applied during the selection time $t_S$. Column electrodes receive either a column voltage pulse $V_{Con}$ 220 for On-state data or a voltage pulse $V_{Coff}$ 240 for Off-state data. The resulting pixel voltage (the difference between the row voltage and column voltage) on the selected row is either $V_{Pson}$ 260 for ON-state or $V_{Psoff}$ 280 for OFF-state. On the non-selected rows, the pixel voltage is either $V_{Pnson}$ 265 when the column voltage is $V_{Con}$ or $V_{Pnsoff}$ 285 when the column voltage is $V_{Coff}$. In this particular example, all row voltage and column voltage pulses ($V_{Rs}$, $V_{Rns}$, $V_{Con}$, $V_{Coff}$) take only two levels, either a maximum voltage level U or a minimum voltage level 0. The pixel voltage pulses ($V_{Pson}$, $V_{Psoff}$, $V_{Pnson}$, $V_{Pnoff}$), however, are bipolar waveforms or zero. The selection time $t_S$ is the time duration in the selection step for each selected row.

Figure 5A:
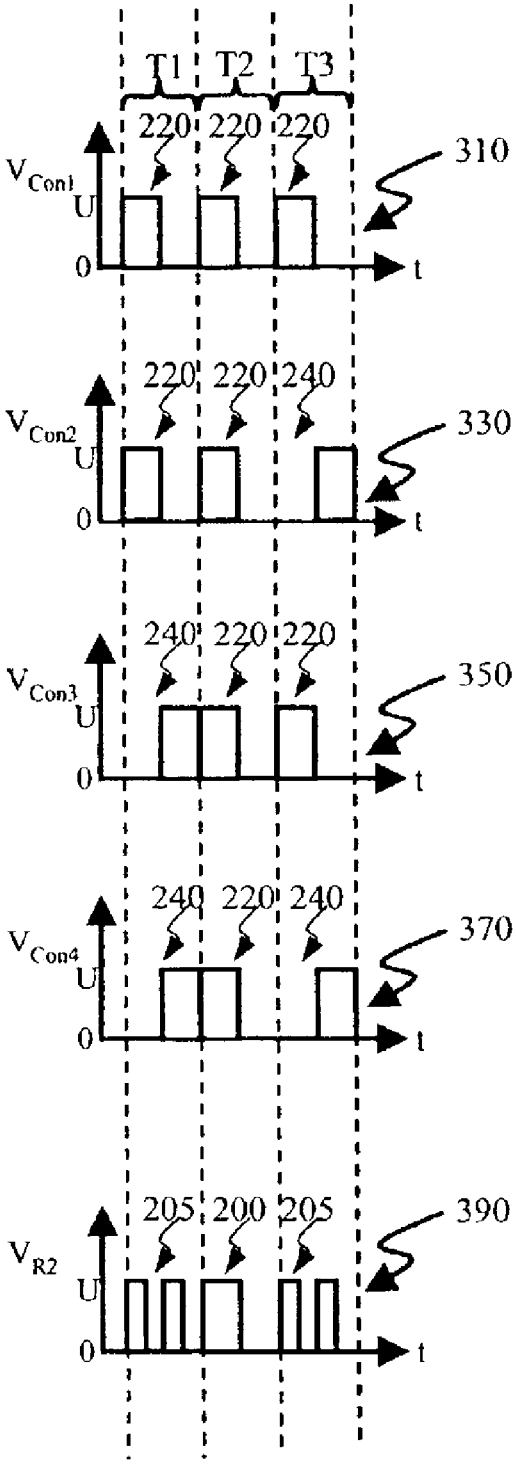
FIG. 5A (PRIOR ART)
FIG. 5A is a schematic diagram showing column and row voltage waveforms having an ON-state data on the second row and various combinations of data on the first and third rows by use of waveforms shown in FIGS. 3 and 4 (prior art)

Referring to FIG. 5A, $V_{R2}$ 390 is a row voltage waveform applied to the second row. Since the second row is selected to be written in the period of T2, it receives selected row voltage pulse 200 in the period of T2, and non-selected row voltage pulses 205 in the periods of T1 and T2 when the first row and the third row are selected. Column voltage waveforms $V_{Con1}$ 310, $V_{Con2}$ 330, $V_{Con3}$ 350, and $V_{Con4}$ 370 all have the same column voltage pulse 220 corresponding to ON-state data in the period of T2, but four different combinations of column voltage pulses (or data voltage pulses) in the periods of T1 and T2. The voltage waveform $V_{Con1}$ 310 has both ON-state data voltage pulses 220 in the periods of T1 and T3, while the waveform $V_{Con4}$ 370 has both OFF-state data voltage pulses 240. On the column voltage waveform $V_{Con2}$ 330, an On-state data voltage pulse 220 appears in the period of T1 and an OFF-state data voltage pulse 240 in the period of T4. On the contrary, the column voltage waveform $V_{Con3}$ 350 has an OFF-state data voltage pulse 240 in the period of T1 and an ON-state data voltage pulse 220 in the period of T4.

Figure 5B:
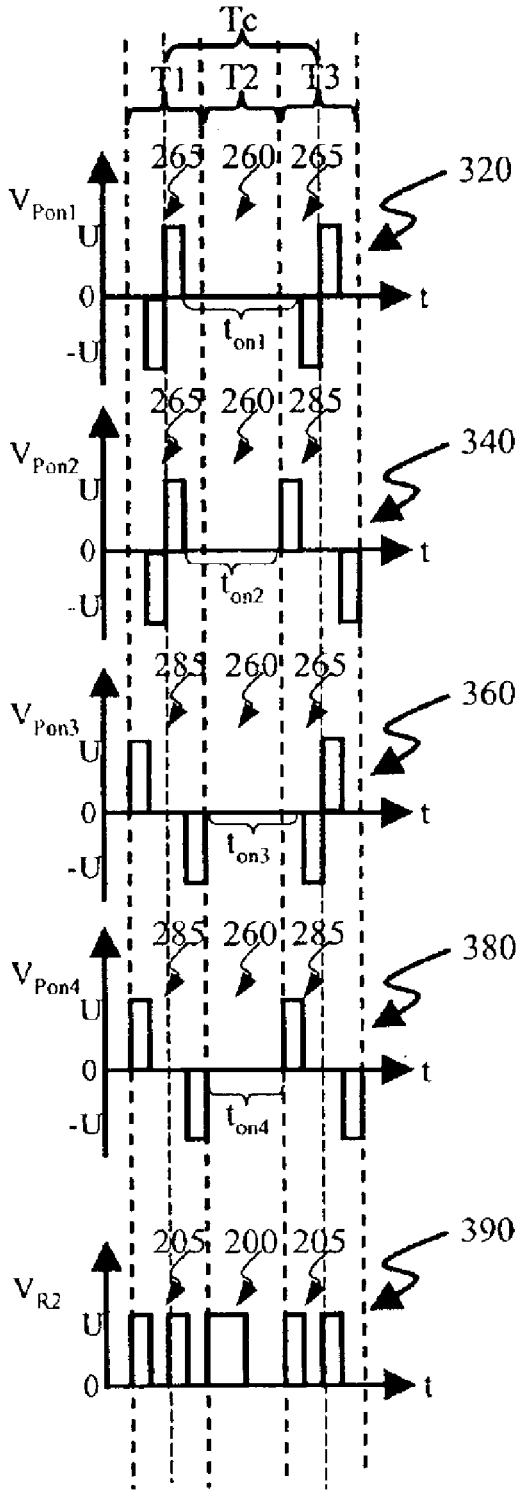
FIG. 5B (PRIOR ART)
FIG. 5B is a schematic diagram showing data dependency of an effective ON-state selection time by use of waveforms shown in FIG. 5A (prior art)

FIG. 5B is a schematic diagram showing the resulting pixel voltage waveforms $V_{Pon1}$ 320, $V_{Pon2}$ 340, $V_{Pon3}$ 360, and $V_{Pon4}$ 380, formed from the row voltage waveform $V_{R2}$ 390, and the four column voltage waveforms $V_{Con1}$ 310, $V_{Con2}$ 330, $V_{Con3}$ 350, and $V_{Con4}$ 370, respectively. For the purpose of comparison, the row voltage waveform $V_{R2}$ 390 is shown in both FIGS. 5A and 5B. All the four pixel voltage waveforms $V_{Pon1}$ 320, $V_{Pon2}$ 340, $V_{Pon3}$ 360, and $V_{Pon4}$ 380 have the same selected ON-state pixel voltage pulse 260 in the selection period of T2 as planned. In this particular example, the selected ON-state pixel voltage pulse 260 is zero volts. However, they have different nonselected voltage pulses, either 265 or 285, immediately before and after the selection period of T2. When the selection period T2 is combined with the period T1 immediately prior to T2, and the period T3 immediately after T2, the ON-state pixel voltage pulses 260 vary their effective ON-state selection times with $t_{on1}$ on $V_{Pon1}$ 320, $t_{on2}$ on $V_{Pon2}$ 340, $t_{on3}$ on $V_{Pon3}$ 360, and $t_{on4}$ on $V_{Pon4}$ 380. The effective ON-state selection times satisfy the relation that $t_{on1}=1.5t_{on4}$, $t_{on2}=t_{on3}=1.25t_{on4}$, and $t_{on4}$=T2. Thus, the maximum effective ON-state selection time $t_{on1}$ is 50% longer than the minimum effective ON-state selection time $t_{on4}$, and the other ON-state selection times $t_{on2}$ and $t_{on3}$ are both 25% more than $t_{on4}$. This will result in an undesirable difference in the On-state of the pixel depending on the state of the preceding or following nonselected pixel voltages.

Figure 5C:
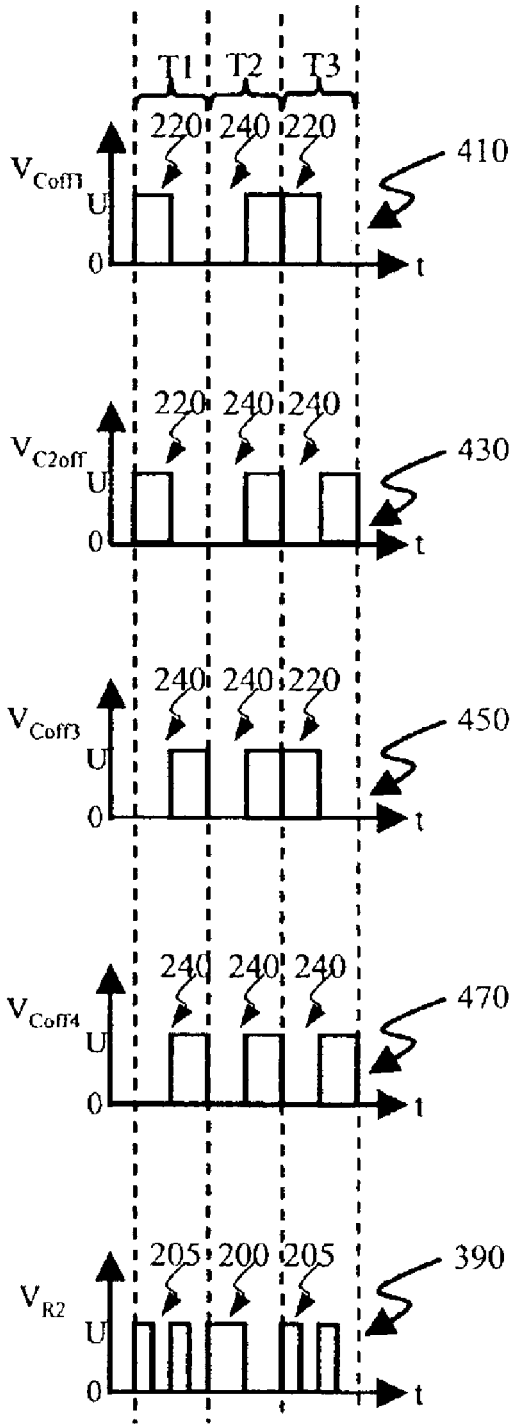
FIG. 5C (PRIOR ART)
FIG. 5C is a schematic diagram showing column and row voltage waveforms having an OFF-state data on the second row and various combinations of data on the first and third rows by use of waveforms shown in FIGS. 4A and 4B (prior art)
Figure 5D:
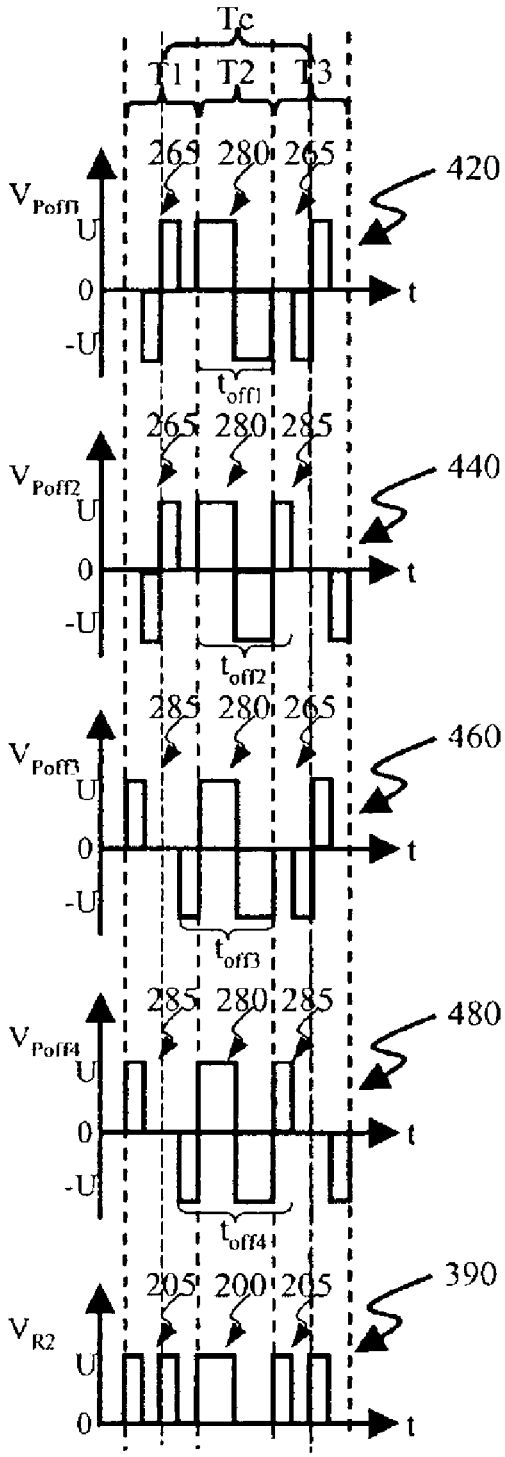
FIG. 5D (PRIOR ART)
FIG. 5D is a schematic diagram showing data dependency of an effective OFF-state selection time by use of waveforms shown in FIG. 5C (prior art)

FIGS. 5C and 5D are similar to FIGS. 5A and 5B; except that an OFF-state data column voltage pulse 240 is applied in the second period of T2 in the four possible column voltage waveforms $V_{Coff1}$ 410, $V_{Coff2}$ 430, $V_{Coff3}$ 450, and $V_{Coff4}$ 370. The resulting pixel voltage waveforms formed from the row voltage waveform $V_{R2}$ 390 and the four column voltage waveforms $V_{Coff1}$ 410, $V_{Coff2}$ 430, $V_{Coff3}$ 450, and $V_{Coff4}$ 470 are $V_{Poff1}$ 420, $V_{Poff2}$ 440, $V_{Poff3}$ 460, and $V_{Poff4}$ 480, respectively. They all have the same OFF-state pixel voltage pulse 280 in the selection period of T2, but different pixel voltage pulses in the periods immediately before and after T2, either 285 if the column voltage pulse is OFF-state pulse 240, or 265 if the column voltage pulse is ON-state pulse 220.

When the selection period T2 is combined with the periods T1 and T3 immediately before and after T2, the OFF-state pixel voltage pulses 280 vary their effective duration with $t_{off1}$ on $V_{Poff1}$ 420, $t_{off2}$ on $V_{Poff2}$ 440, $t_{off3}$ on $V_{Poff3}$ 460, and $t_{off4}$ on $V_{Poff4}$ 480. The effective OFF-state selection times satisfy that $t_{off4}=1.5t_{off1}$, $t_{off2}=t_{off3}=1.25t_{off1}$ and $t_{off1}$=T2. Thus, the maximum effective OFF-state selection time $t_{off4}$ is 50% longer than the minimum effective OFF-state selection time $t_{off1}$, and the other OFF-state selection times $t_{off2}$ and $t_{off3}$ are both 25% more than $t_{off1}$. This will result in an undesirable difference in the Off-state of the pixel depending on the state of the preceding or following nonselected pixel voltages.

FIG. 5B and FIG. 5D clearly show that the effective ON-state and OFF-state selection times depend on the state of neighboring pixels and vary with the data pattern appearing immediately before and after a particular row. The data dependence of the effective selection time causes an unpredictable variation of optical states.

Although the pixel voltage has an average of zero volts in the selection period of T2, a careful examination of pixel voltage waveforms reveals that the local average voltage <V> over Tc, which is a duration including the selection period T2 and a 50% period before and after T2, also varies with data pattern. Referring back to FIG. 5B, during the period of Tc, which includes the second half of T1, T2, and the first half of T3, the root mean square (RMS) values are $$0,\ \frac{1}{4}U,\ -\frac{1}{4}U,\ \text{and } 0$$

but the local average values of voltage <V> are $$\frac{1}{2}U,$$

on $V_{Pon1}$ 320, $V_{Pon2}$ 340, $V_{Pon3}$ 360, and $V_{Pon4}$ 380 respectively. Referring to FIG. 5D, during the same period of Tc, the pixel voltage waveforms $V_{Poff1}$ 420, $V_{Poff2}$ 440, $V_{Poff3}$ 460, and $V_{Poff4}$ 480 have the same RMS values of $$\sqrt{\frac{3}{4}}\,U,$$

and average values <V> of $$0,\ \frac{1}{4}U,\ -\frac{1}{4}U,\ \text{and } 0,$$

respectively. Both data pattern dependent effective selection time and local average voltage cause difficulty in searching for optimized driving parameters such as amplitude, frequency, and duration of voltage waveforms.

According to the present invention, the data dependence of the effective selection time is minimized by inserting a framing voltage pulse between each successive selected pixel voltage pulse such that the effective selection time and local average voltage are the same for every pixel in the display, whereby the display state of a pixel is independent of the display state of neighboring pixels.

Figure 6A:
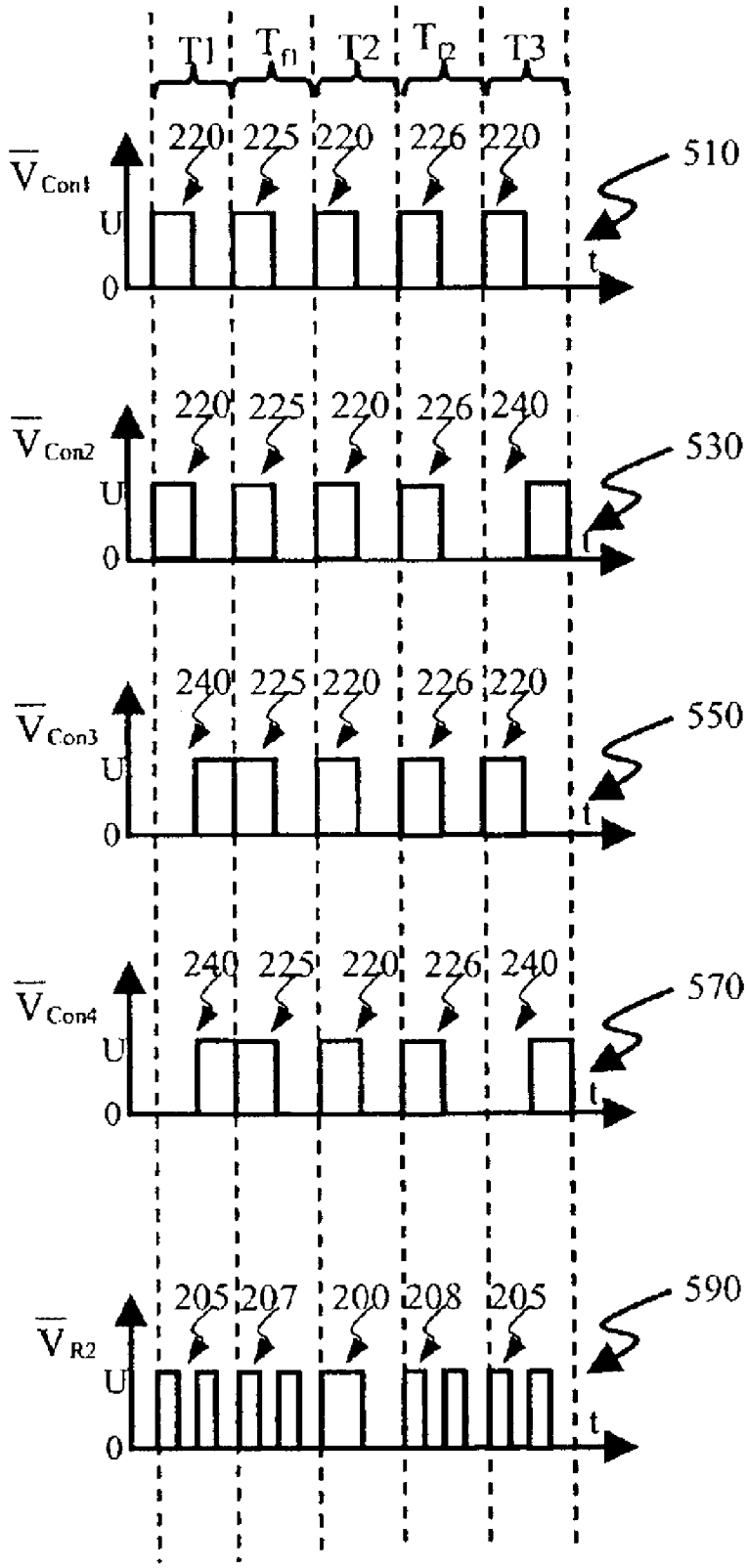
FIG. 6A is a schematic diagram showing improved row and column voltage waveforms that minimize data dependency of an effective ON-state selection time in accordance with one embodiment of the present invention.

A first embodiment of the present invention will be described referring to FIGS. 6A through 6D. FIG. 6A shows the row voltage waveform $\overline{V}_{R2}$ 590 and four possible column voltage waveforms $\overline{V}_{Con1}$ 510, $\overline{V}_{Con2}$ 530, $\overline{V}_{Con3}$ 550, and $\overline{V}_{Con4}$ 570 which have ON-state data voltage pulses in the period of T2. They correspond to the row voltage waveform $V_{R2}$ 390 and four possible column voltage waveforms $V_{Con1}$ 310, $V_{Con2}$ 330, $V_{Con3}$ 350, and $V_{Con4}$ 370, shown in FIG. 5A, respectively.

Each of the column voltage waveforms $\overline{V}_{Con1}$ 510, $\overline{V}_{Con2}$ 530, $\overline{V}_{Con3}$ 550, and $\overline{V}_{Con4}$ 570 has a common framing voltage pulse 225 in the frame period $T_{f1}$ inserted prior to the selection period of T2 and another common framing voltage pulse 226 in the frame period $T_{f2}$ inserted after the selection period T2. In the two inserted frame periods of $T_{f1}$ and $T_{f2}$, the row voltage waveform $\overline{V}_{R2}$ 590 has voltage pulses 207 and 208, which are the same as the non-selected row voltage pulses 205 in this particular example.

Figure 6B:
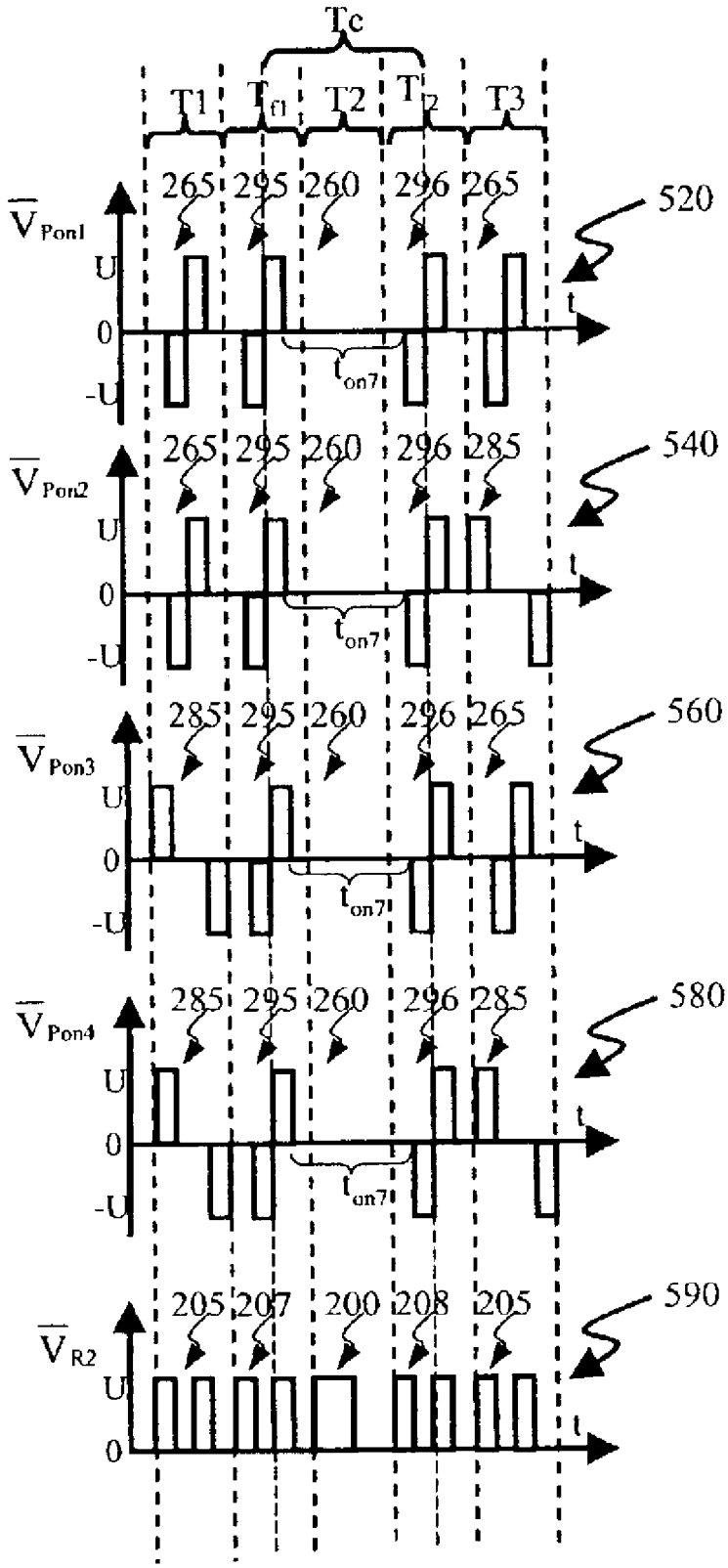
FIG. 6B is a schematic diagram showing improved pixel voltage waveforms that minimize data dependency of an effective ON-state selection time by use of row and column voltage waveforms shown in FIG. 6A.

FIG. 6B shows the resulting pixel voltage waveforms $\overline{V}_{Pon1}$ 520, $\overline{V}_{Pon2}$ 540, $\overline{V}_{Pon3}$ 560, and $\overline{V}_{Pon4}$ 580 formed from the row voltage waveform $\overline{V}_{R2}$ 590 and the four column voltage waveforms, $\overline{V}_{Con1}$ 510, $\overline{V}_{Con2}$ 530, $\overline{V}_{Con3}$ 550, and $\overline{V}_{Con4}$ 570, respectively. They all have the same pixel voltage pulses 295 and 296 in the inserted frame periods of $T_{f1}$ and $T_{f2}$. When the selection period T2 is combined with the periods $T_{f1}$ and $T_{f2}$ immediately before and after T2, the ON-state pixel voltage pulses 260 have the same effective ON-state selection time $t_{on7}$, unchanged in pixel voltage waveforms $\overline{V}_{Pon1}$ 520, $\overline{V}_{Pon2}$ 540, $\overline{V}_{Pon3}$ 560, and $\overline{V}_{Pon4}$ 580.

Figure 6C:
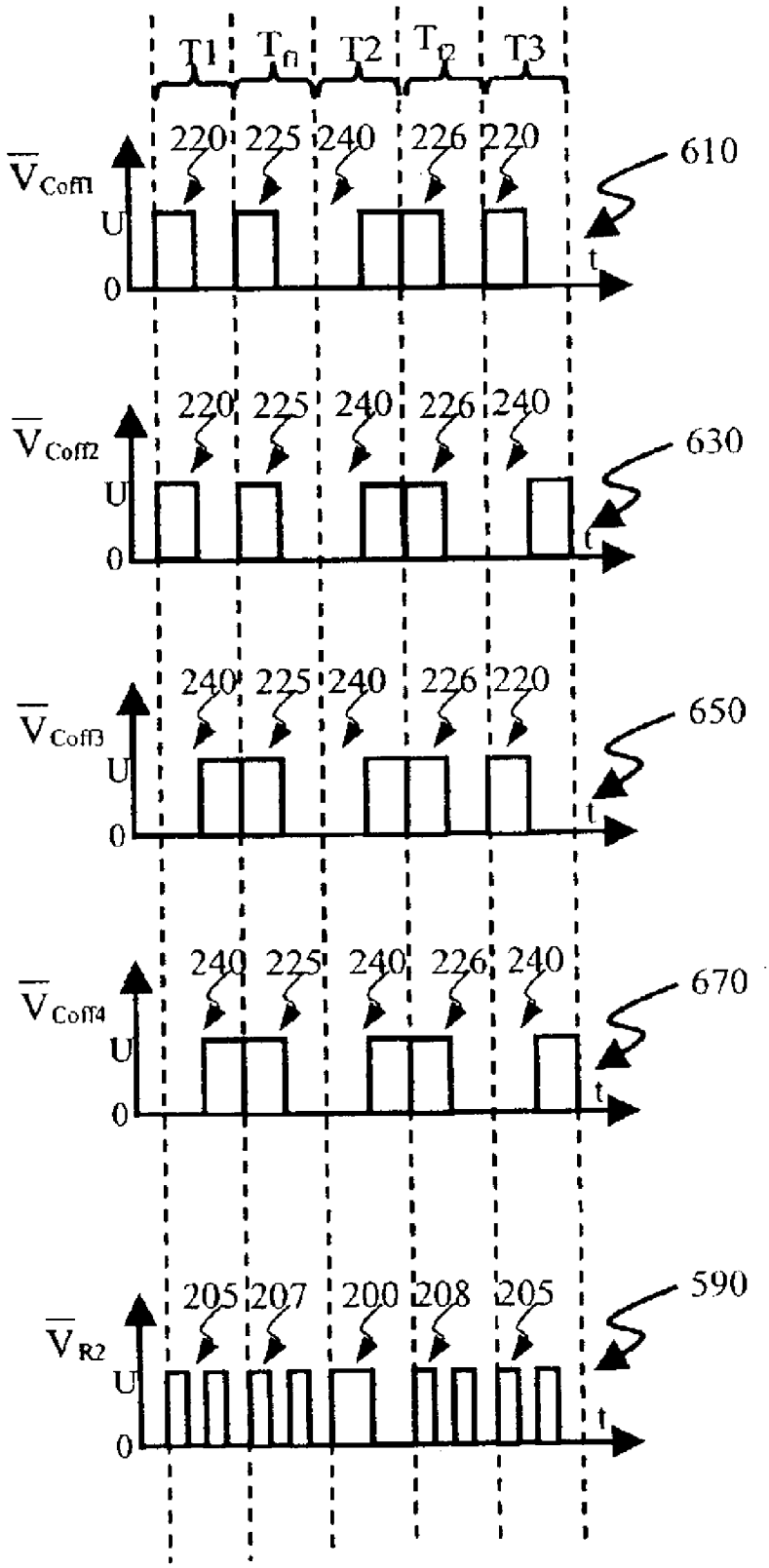
FIG. 6C is a schematic diagram showing improved row and column voltage waveforms that minimize data dependency of an effective OFF-state selection time in accordance with one embodiment of the present invention.
Figure 6D:
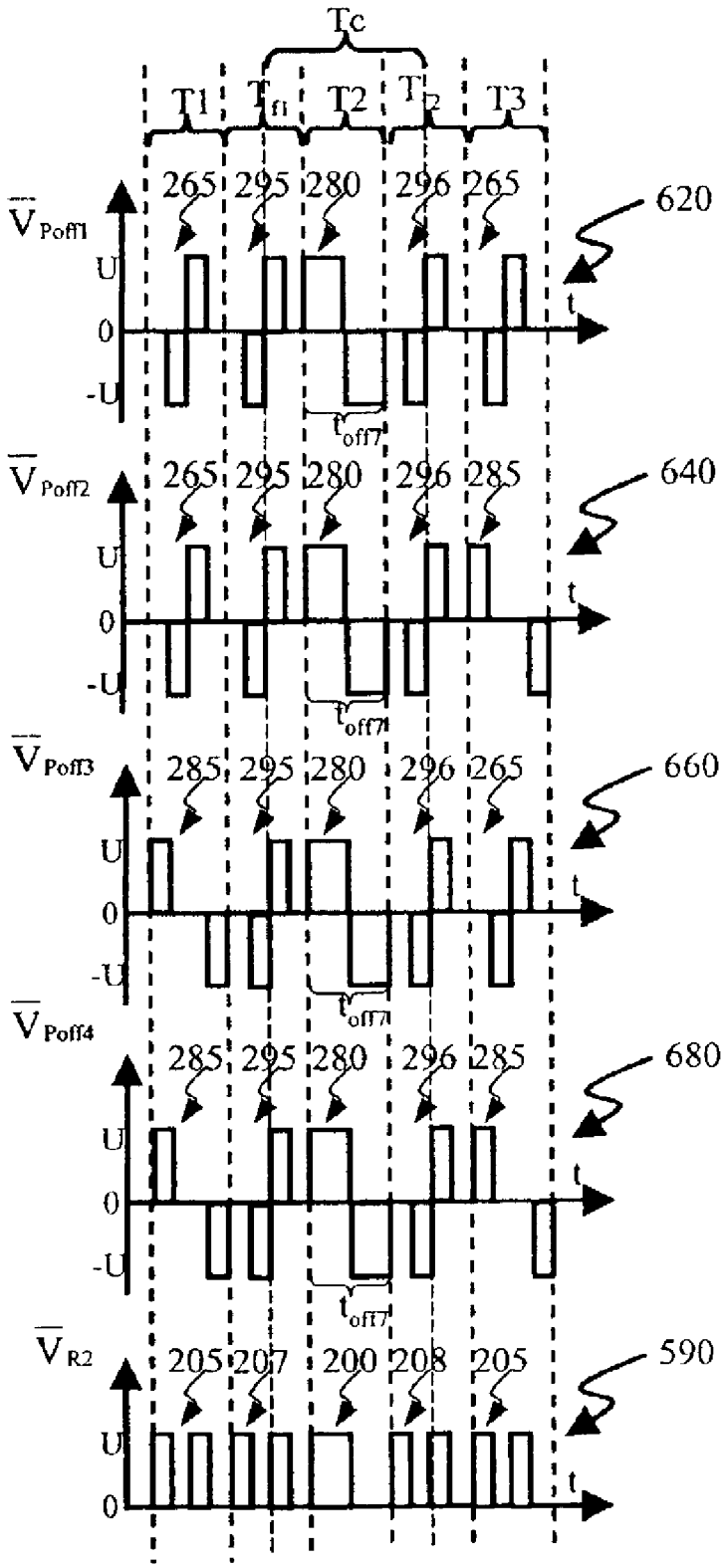
FIG. 6D is a schematic diagram showing improved pixel voltage waveforms that minimize data dependency of an effective OFF-state selection time by use of row and column voltage waveforms shown in FIG. 6C.

The same inserted framing voltage pulses also minimizes the data dependence for the effective OFF-state selection time as illustrated in FIGS. 6C and 6D. Resulting pixel voltage waveforms $\overline{V}_{Poff1}$ 620, $\overline{V}_{Poff2}$ 640, $\overline{V}_{Poff3}$ 660, and $\overline{V}_{Poff4}$ 680 are formed from the row voltage waveform $\overline{V}_{R2}$ 590 and the four possible column voltage waveforms, $\overline{V}_{Coff1}$ 610, $\overline{V}_{Coff2}$ 630, $\overline{V}_{Coff3}$ 650, and $\overline{V}_{Coff4}$ 670, respectively. In the period of T2, all column voltage waveforms $\overline{V}_{Coff1}$ 610, $\overline{V}_{Coff2}$ 630, $\overline{V}_{Coff3}$ 650, and $\overline{V}_{Coff4}$ 670 have an OFF-state column voltage pulse 240 as shown in FIG. 6C, and all pixel voltage waveforms $\overline{V}_{Poff1}$ 620, $\overline{V}_{Poff2}$ 640, $\overline{V}_{Poff3}$ 660, and $\overline{V}_{Poff4}$ 680 have an OFF-state pixel voltage pulse 280 as shown in FIG. 6D. Due to the fixed pixel voltage pulses 295 and 296 in the inserted frame periods of $T_{f1}$ and $T_{f2}$, the effective OFF-state selection time becomes $t_{off7}$, which is independent of the display state of neighboring pixels.

Referring to FIG. 6B, during the period of Tc, which now includes the second half of $T_{f1}$, T2, and the first half of $T_{f2}$, the pixel voltage waveforms $\overline{V}_{Pon1}$ 520, $\overline{V}_{Pon2}$ 540, $\overline{V}_{Pon3}$ 560, and $\overline{V}_{Pon4}$ 580 have the same RMS values of $$\frac{1}{2}U,$$

and the same local average voltage values <V> of 0.

Referring to FIG. 6D, during the period of Tc, which also includes the second half of $T_{f1}$, T2, and the first half of $T_{f2}$, the pixel voltage waveforms $\overline{V}_{Poff1}$ 620, $\overline{V}_{Poff2}$ 640, $\overline{V}_{Poff3}$ 660, and $\overline{V}_{Poff4}$ 680 have the same RMS values of $$\sqrt{\frac{3}{4}}\,U,$$

and the same local average voltage values <V> of 0.

Although this first embodiment described with respect to FIGS. 6A through 6D solves both the problems of variable effective selection time and variable local average selection voltage, the effective ON-state selection time $t_{on7}$ and OFF-state selection time $t_{off7}$ are different. This may not be a problem, and may be an advantage in some cases where it is desirable to have different ON-state and OFF-state selection times.

Figure 7A:
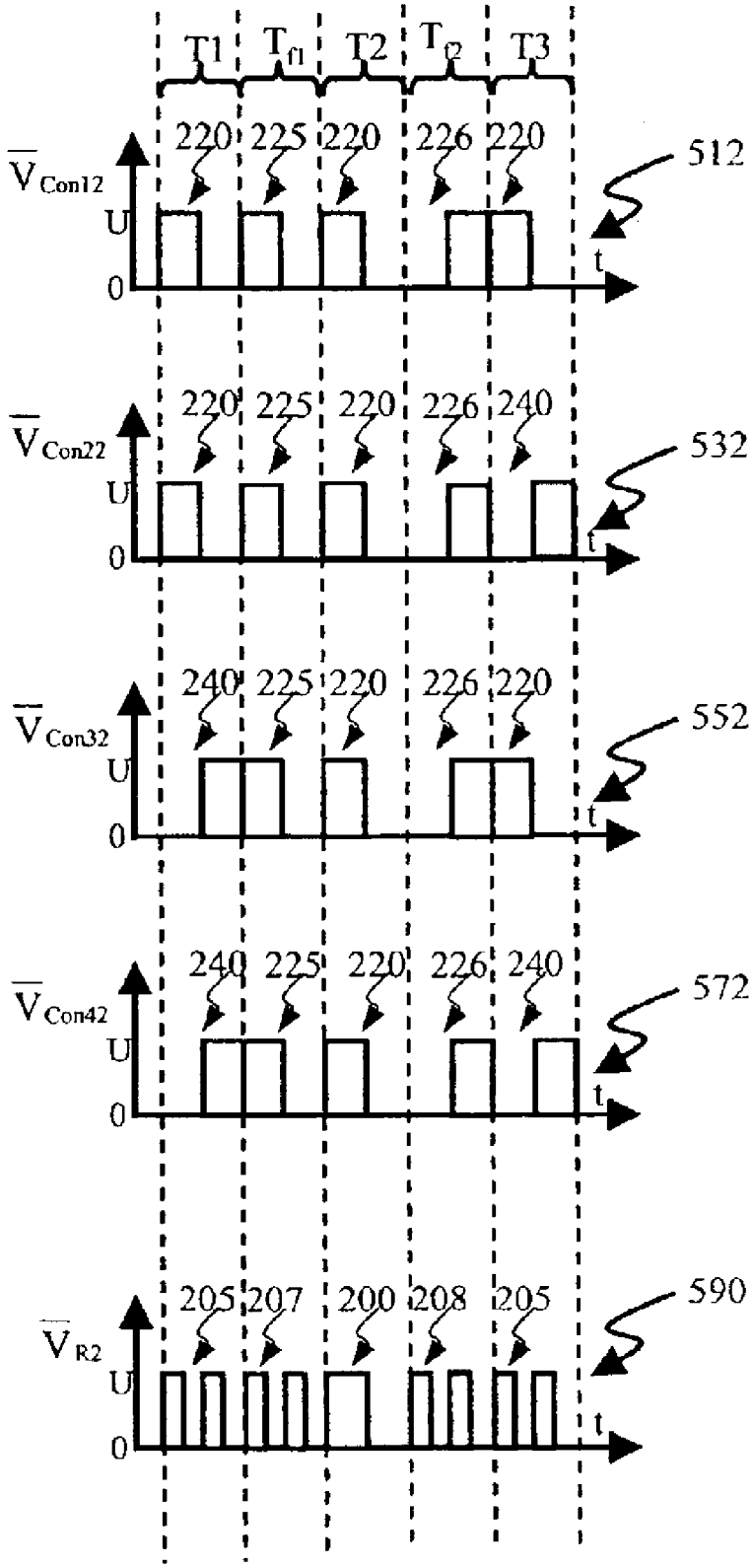
FIG. 7A is a schematic diagram showing improved row and column voltage waveforms that minimize data dependency of an effective ON-state selection time in accordance with an alternative embodiment of the present invention.

According to an alternative embodiment of the present invention illustrated in FIGS. 7A through 7D, the effective ON-state and OFF-state selection times are made to be the same. FIG. 7A shows the row voltage waveform $\overline{V}_{R2}$ 590 and the four possible column voltage waveforms $\overline{V}_{Con12}$ 512, $\overline{V}_{Con22}$ 532, $\overline{V}_{Con32}$ 552, and $\overline{V}_{Con42}$ 572, each having an ON-state column voltage pulse 220 in the period of T2, but different voltage pulses in the periods of T1 and T2. The corresponding pixel voltage waveforms are $\overline{V}_{Pon12}$ 522, $\overline{V}_{Pon22}$ 542, $\overline{V}_{Pon32}$ 562, and $\overline{V}_{Pon42}$ 582, respectively, shown in FIG. 7B.

Figure 7B:
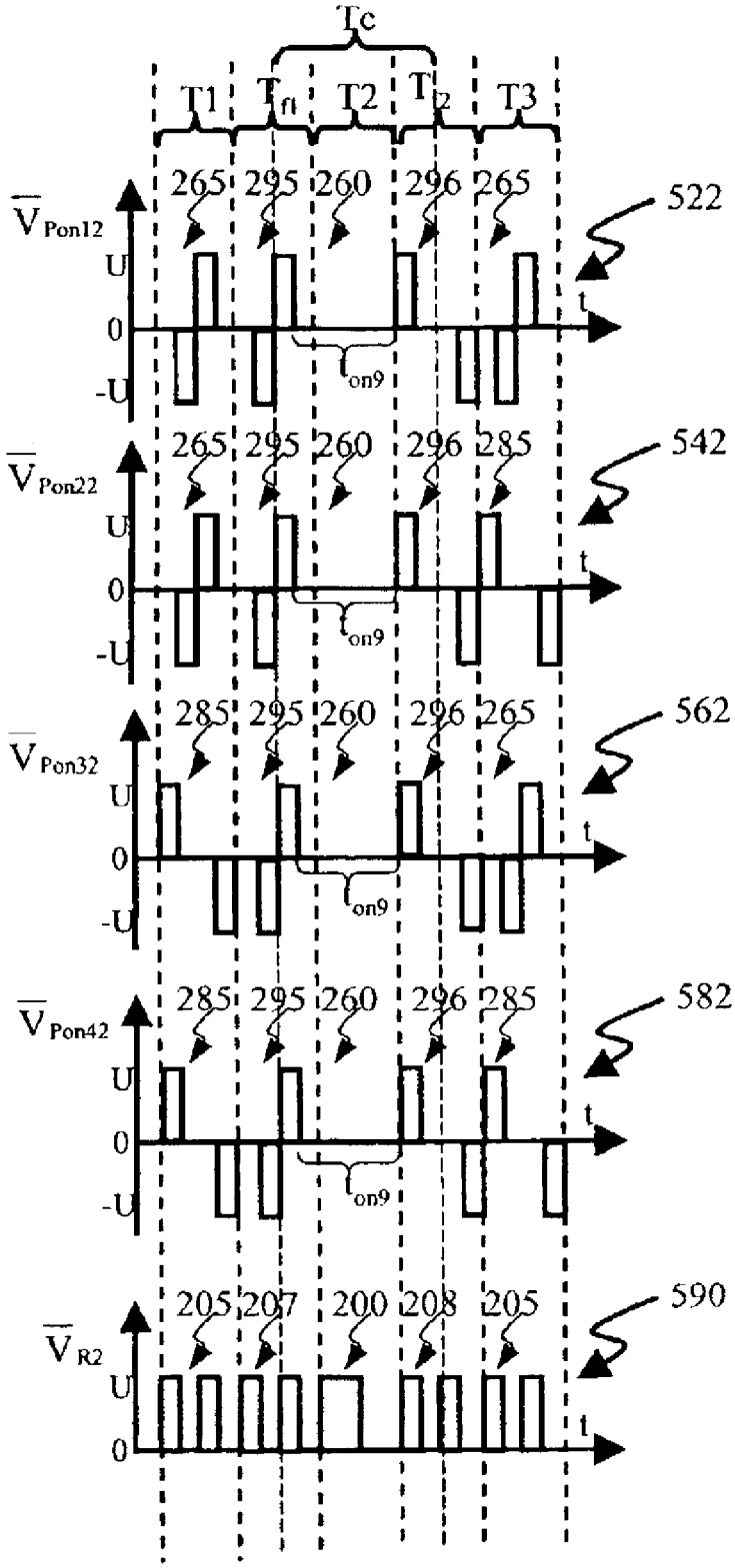
FIG. 7B is a schematic diagram showing improved pixel voltage waveforms that minimize data dependency of an effective ON-state selection time by use of row and column voltage waveforms shown in FIG. 7A.
Figure 7C:
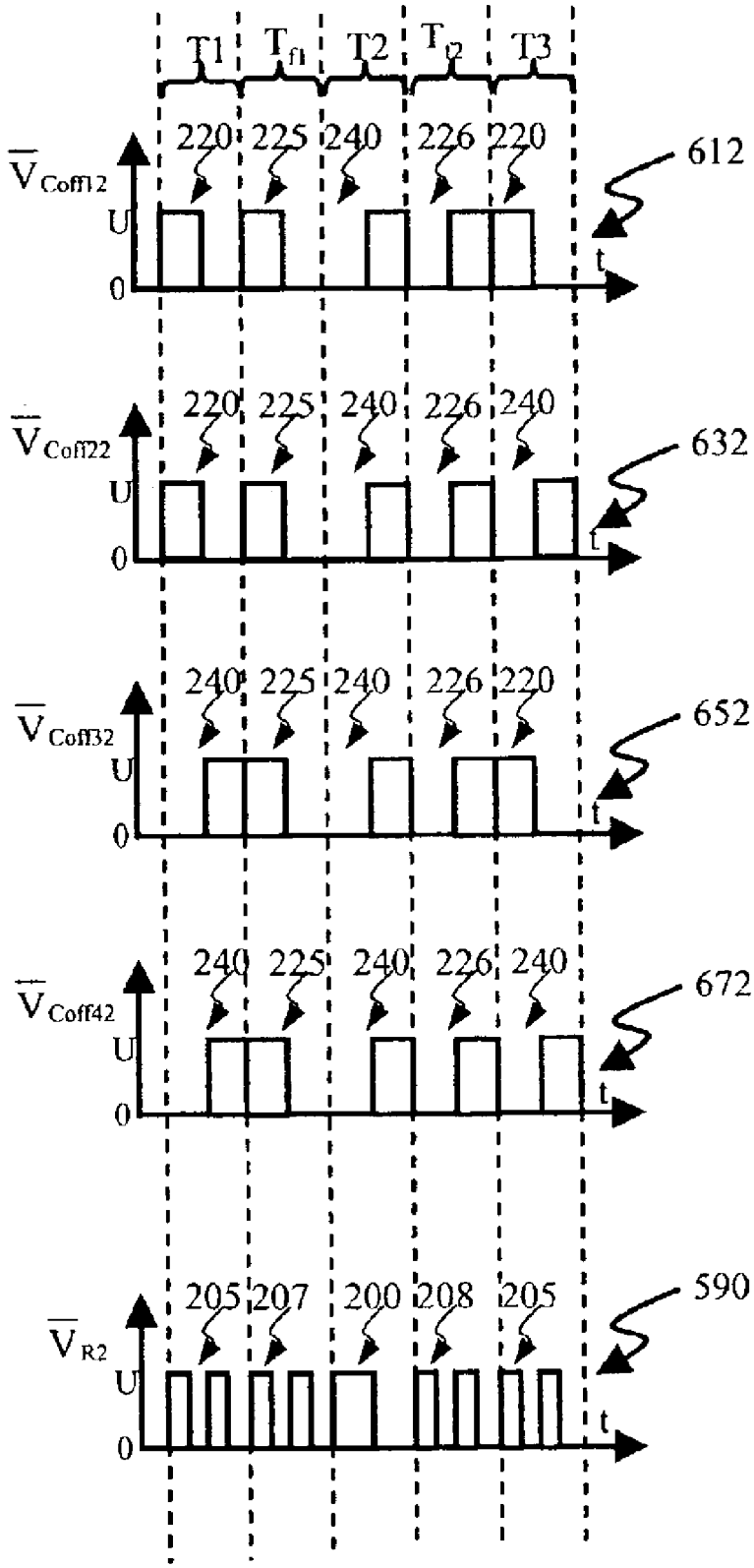
FIG. 7C is a schematic diagram showing improved row and column voltage waveforms that minimize data dependency of an effective OFF-state selection time in accordance with the alternative embodiment of the present invention.
Figure 7D:
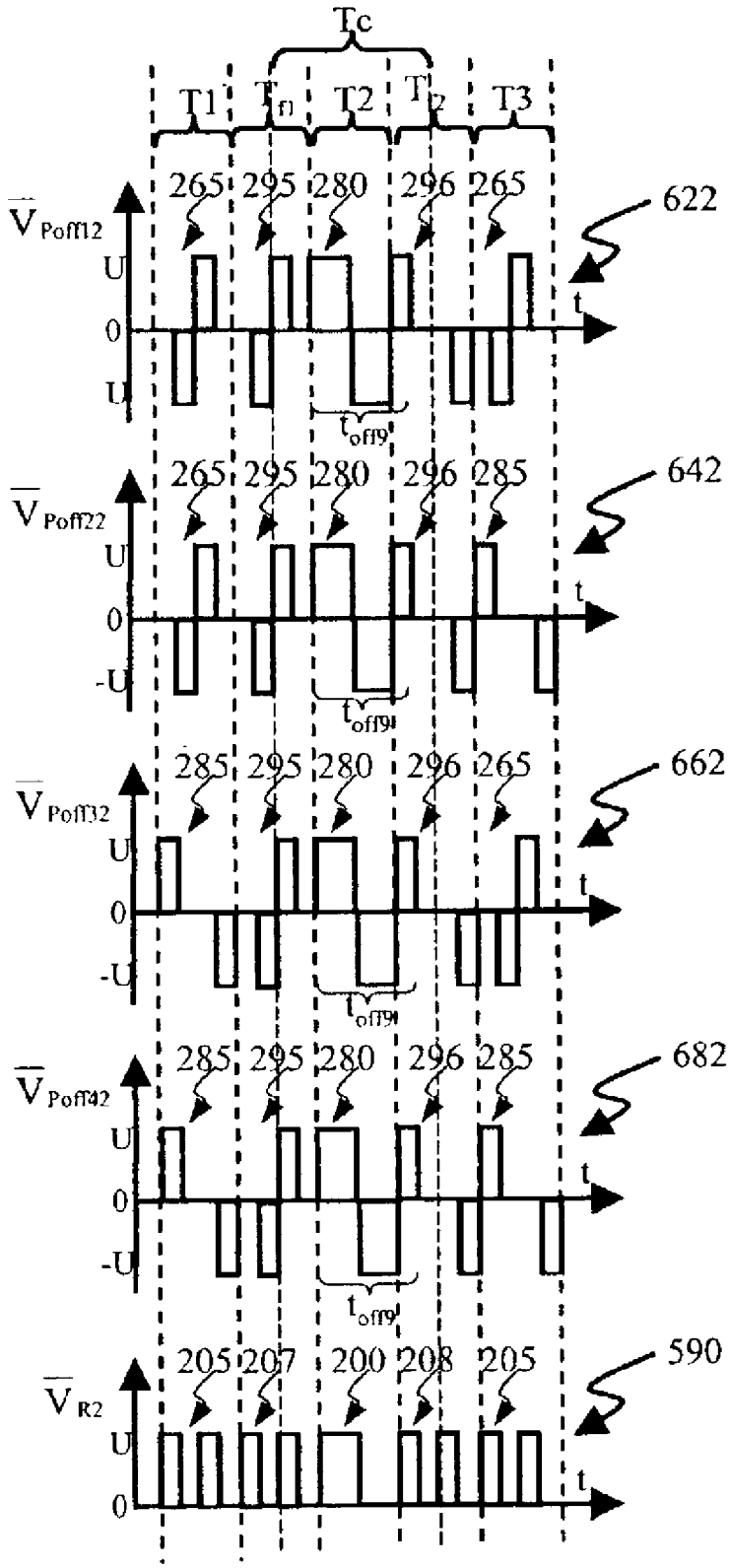
FIG. 7D is a schematic diagram showing improved pixel voltage waveforms that minimize data dependency of an effective OFF-state selection time by use of row and column voltage waveforms shown in FIG. 7C.

FIG. 7C shows the row voltage waveform $\overline{V}_{R2}$ 590 and the four possible column voltage waveforms $\overline{V}_{Coff12}$ 612, $\overline{V}_{Coff22}$ 632, $\overline{V}_{Coff32}$ 652, and $\overline{V}_{Coff42}$ 672, each having an OFF-state column voltage pulse 240 in the period of T2, but different voltage pulses in the periods of T1 and T2. FIG. 7D shows the resulting pixel voltage waveforms $\overline{V}_{Poff12}$ 622, $\overline{V}_{Poff22}$ 642, $\overline{V}_{Poff32}$ 662, and $\overline{V}_{Poff42}$ 682, formed from the row voltage waveform $\overline{V}_{R2}$ 590 and the four column voltage waveforms $\overline{V}_{Coff12}$ 612, $\overline{V}_{Coff22}$ 632, $\overline{V}_{Coff32}$ 652, and $\overline{V}_{Coff42}$ 672, respectively.

According to this alternative embodiment, in the second inserted frame $T_{f2}$, the column voltage pulses 226 in FIGS. 7A and 7C take the form of $V_{Coff}$ 240 instead of $V_{Con}$ 220 as in FIGS. 6A and 6C, and consequently, the resulting pixel voltage pulses 296 in FIGS. 7B and 7D take the form of $V_{Pnsoff}$ 285 instead of $V_{Pnson}$ 265 in FIGS. 6B and 6D. The inserted framing voltage pulses in the periods of $T_{f1}$ and $T_{f2}$ shown in FIGS. 7A through 7D take different forms. The effective ON-state selection time $t_{on9}$ associated with the pixel voltage pulse 260 shown in FIG. 7B has the same duration as the effective OFF-state selection time $t_{off9}$ associated with the pixel voltage pulse 280 as shown in FIG. 7D. Both effective selection times $t_{on9}$ and $t_{off9}$ are equal to 1.25T2. This alternative embodiment not only solves both the problems of variable effective selection times and variable local average selection voltage, but also has $t_{on9}$ and $t_{off9}$ times that are equal. However, the value of local average selection voltage is not zero.

Referring to FIG. 7B, during the period of Tc, the pixel voltage waveforms $\overline{V}_{Pon12}$ 522, $\overline{V}_{Pon22}$ 542, $\overline{V}_{Pon32}$ 562, and $\overline{V}_{Pon42}$ 582 have the same RMS values of $$\frac{1}{2}U,$$

and the same average voltage values <V>of $$\frac{1}{4}U.$$

Referring to FIG. 7D, during the period of Tc, the pixel voltage waveforms $\overline{V}_{Poff12}$ 622, $\overline{V}_{Poff22}$ 642, $\overline{V}_{Poff32}$ 662, and $\overline{V}_{Poff42}$ 682 have the same RMS values of $$\sqrt{\frac{3}{4}}\,U,$$

and the same non-zero local average voltage values <V> of $$\frac{1}{4}U.$$

Figure 8A:
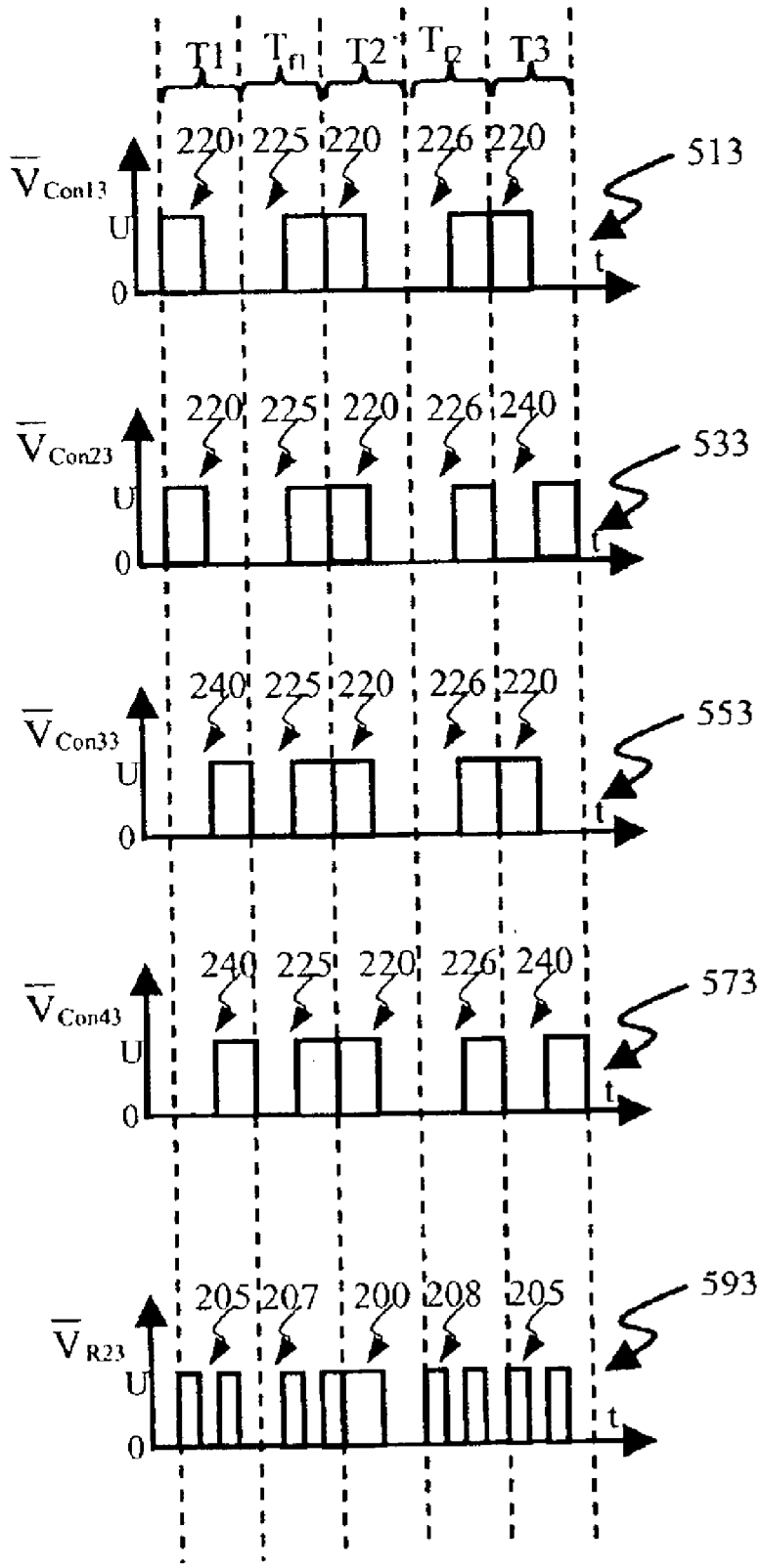
FIG. 8A is a schematic diagram showing improved row and column voltage waveforms that minimize data dependency of an effective ON-state selection time in accordance with a further alternative embodiment of the present invention.

A still further embodiment of the present invention that has equal ON-state and OFF-state selection times, and that also provides zero value of local average selection voltages is shown in FIGS. 8A through 8D. FIG. 8A shows the row voltage waveform $\overline{V}_{R23}$ 593 and the four possible column voltage waveforms, $\overline{V}_{Con13}$ 513, $\overline{V}_{Con23}$ 533, $\overline{V}_{Con33}$ 553, and $\overline{V}_{Con43}$ 573, each having an ON-state column voltage pulse 220 in the period of T2, but different voltage pulses in the periods of T1 and T2. The corresponding pixel voltage waveforms are $\overline{V}_{Pon13}$ 523, $\overline{V}_{Pon23}$ 543, $\overline{V}_{Pon33}$ 563, and $\overline{V}_{Pon43}$ 583, respectively, shown in FIG. 8B.

Figure 8B:
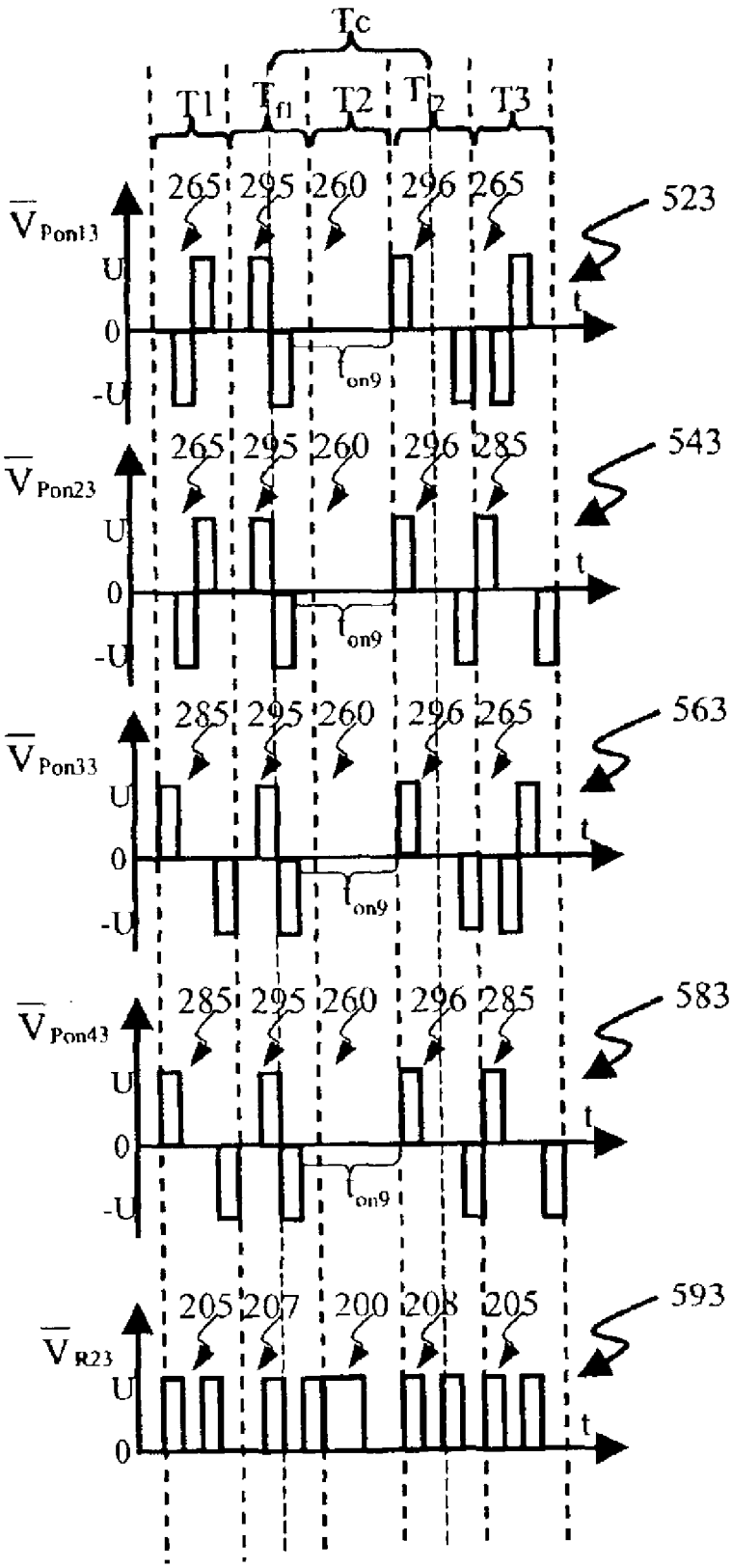
FIG. 8B is a schematic diagram showing improved pixel voltage waveforms that minimize data dependency of an effective ON-state selection time by use of row and column voltage waveforms shown in FIG. 8A.
Figure 8C:
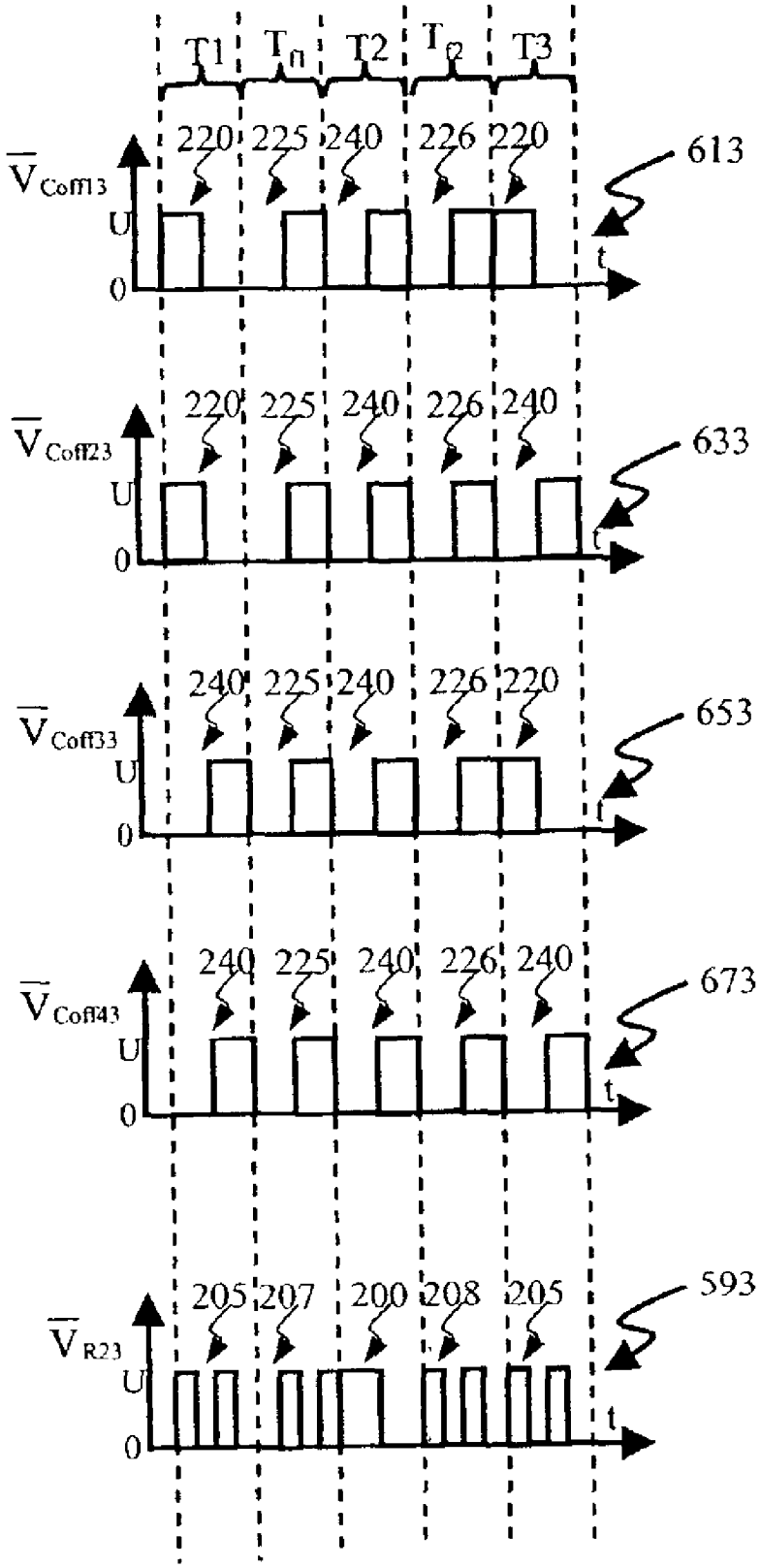
FIG. 8C is a schematic diagram showing improved row and column voltage waveforms that minimize data dependency of an effective OFF-state selection time in accordance with the further alternative embodiment of the present invention.
Figure 8D:
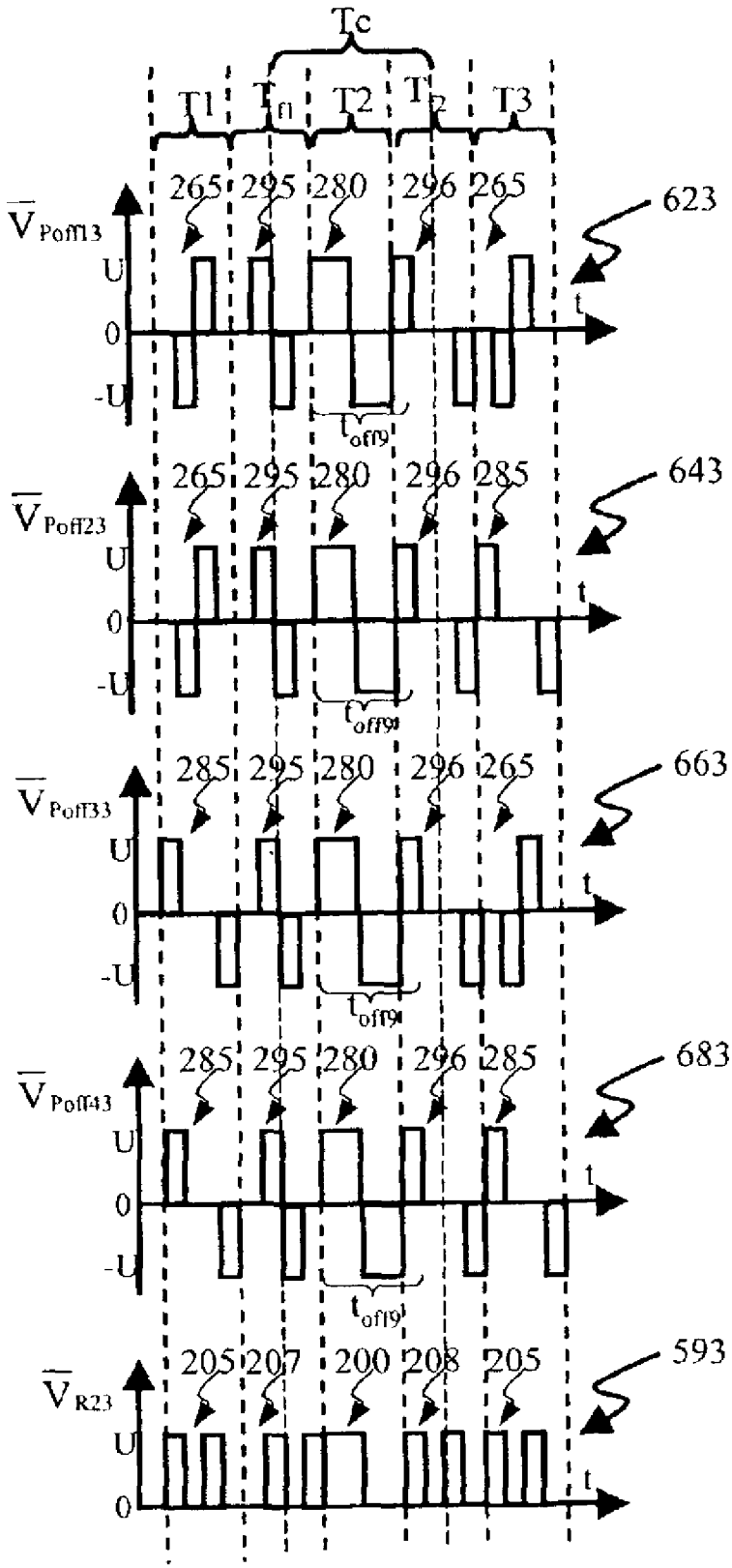
FIG. 8D is a schematic diagram showing improved pixel voltage waveforms that minimize data dependency of an effective OFF-state selection time by use of row and column voltage waveforms shown in FIG. 8C.

FIG. 8C shows the row voltage waveform $\overline{V}_{R23}$ 593 and the four possible column voltage waveforms $\overline{V}_{Coff13}$ 613, $\overline{V}_{Coff23}$ 633, $\overline{V}_{Coff33}$ 653, and $\overline{V}_{Coff43}$ 673, each having an OFF-state column voltage pulse 240 in the period of T2, but different voltage pulses in the periods of T1 and T2. FIG. 8D shows the resulting pixel voltage waveforms $\overline{V}_{Poff13}$ 623, $\overline{V}_{Poff23}$ 643, $\overline{V}_{Poff33}$ 663, and $\overline{V}_{Poff43}$ 683, formed from the row voltage waveform $\overline{V}_{R23}$ 593 and the four column voltage waveforms $\overline{V}_{Coff13}$ 613, $\overline{V}_{Coff23}$ 633, $\overline{V}_{Coff33}$ 653, and $\overline{V}_{Coff43}$ 673, respectively.

According to this embodiment, the column voltage pulses 225 and 226 in both the first inserted frame $T_{f1}$ and second inserted frame $T_{f2}$ in FIGS. 8A and 8C take the form of $V_{Coff}$ 240 instead of $V_{Con}$ 220 as in FIGS. 6A and 6C. The row voltage waveform $\overline{V}_{R23}$ 593 has a voltage pulse 207 in the first inserted frame $T_{f1}$, which is out of phase relative to the voltage pulse 208 in the second inserted frame $T_{f2}$. Thus, the inserted framing voltage pulses in the periods of $T_{f1}$ and $T_{f2}$ take different forms on the row voltage waveform. Consequently, the resulting pixel voltage pulses 296 in FIGS. 8B and 8D take the form of $V_{Pnsoff}$ 285 instead of $V_{Pnson}$ 265 in FIGS. 6B and 6D. In addition, the resulting pixel voltage pulses 295 in FIGS. 8B and 8D have reversed polarity compared to the pixel voltage pulses 295 shown in FIGS. 6B, 6D, 7B, and 7D.

In return, the effective ON-state selection time $t_{on9}$ associated with the pixel voltage pulse 260 shown in FIG. 8B has the same duration as the effective OFF-state selection time $t_{off9}$ associated with the pixel voltage pulse 280 as shown in FIG. 8D. Both effective selection times $t_{on9}$ and $t_{off9}$ are equal to 1.25T2.

Referring to FIG. 8B, during the period of Tc, the pixel voltage waveforms $\overline{V}_{Pon13}$ 523, $\overline{V}_{Pon23}$ 543, $\overline{V}_{Pon33}$ 563, and $\overline{V}_{Pon43}$ 583 have the same RMS values of ½ U , and the same local average voltage values <V> of 0.

Referring to FIG. 8D, during the period of Tc, the pixel voltage waveforms $\overline{V}_{Poff13}$ 623, $\overline{V}_{Poff23}$ 643, $\overline{V}_{Poff33}$ 663, and $\overline{V}_{Poff43}$ 683 have the same RMS values of $$\sqrt{\frac{3}{4}}\,U,$$

and the same local average voltage values <V> of 0.

Thus it can be seen from the above described embodiments that by inserting the frame waveforms according to the present invention control over local average voltage (or DC net voltage) is achieved. The local average voltage can be varied independent of any data pattern and can be either zero or nonzero. This is a desired property for achieving high display performance.

Figure 11:
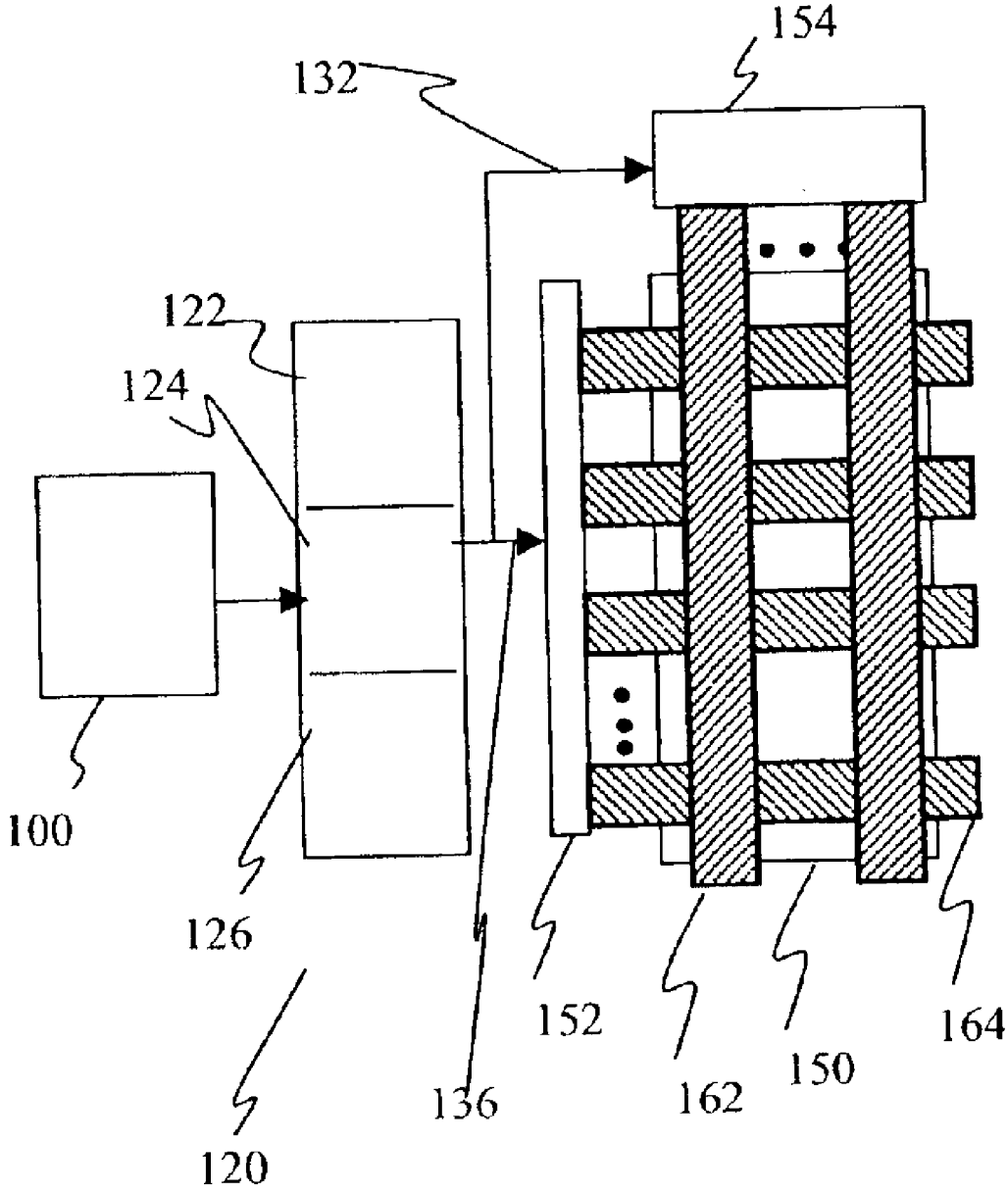
FIG. 11 is a schematic block diagram of an LCD display system and the control electronics for performing the invention.

Inserting framing voltage pulses according to the invention can be implemented in various ways within the scope of the invention. For example, FIG. 11 shows a display system that can be used to produce the waveforms according to the present invention that includes control electronics 120 and a voltage source 100 that generates a voltage at a maximum voltage U. The output voltage U is coupled to a duty cycle controller 122 that generates pulses or voltage signals. A phase controller 124 sets the relative phase of a train of row output pulses with respect to the column pulse train, and a frequency controller 126 that sets the period of the output pulses. The period may be the same for both sets of pulses or different. The output pulses include column pulses 132 and row pulses 136.

The display 150 receives the respective pulses in the column driver 154 and the row driver 152. The drivers apply the pulses to the column electrodes and row electrodes 162, 164 of the display. The individual controllers 122, 124, and 126 may be separated into two sets of controllers, one set for the rows and one set for the columns.

Figure 9A:
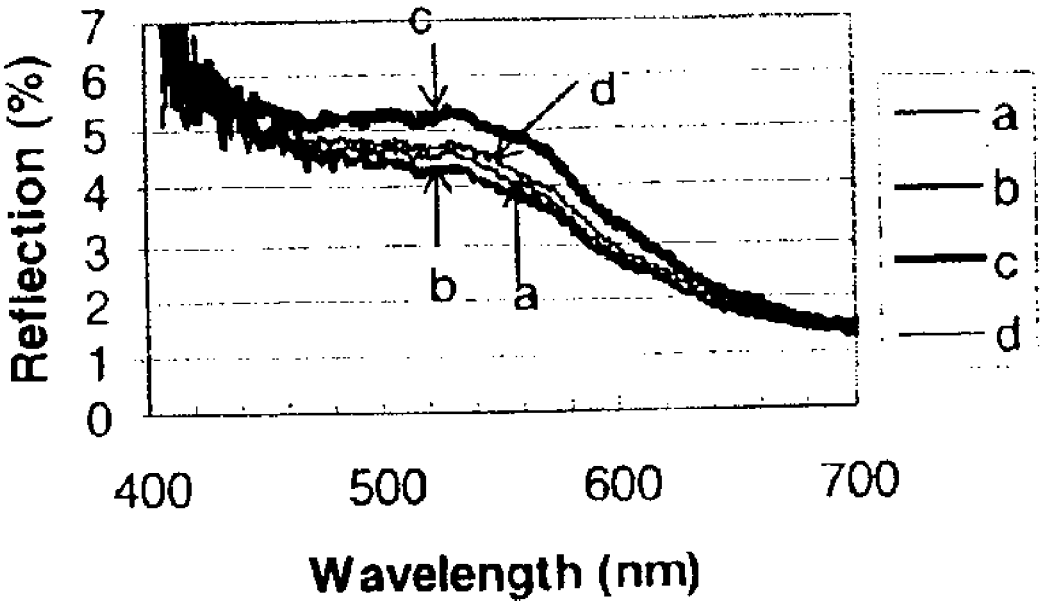
FIGS. 9A, 9B are experimental data showing data dependency of an ON-state and an OFF-state, respectively, in a prior art drive scheme using the waveforms shown in FIG. 4A.

Experimental measurements were taken using cholesteric liquid crystals display driven by a dynamic drive scheme that had the problem that is addressed by the present invention. Referring to FIG. 9A, there are shown four curves of reflectance as a function of wavelength for an OFF-state (or dark state) pixel of a cholesteric liquid crystal display, corresponding to four possible data pattern combinations on neighboring pixels: ON-state/ON-state (Curve a), ON-state/Off-state (Curve b), OFF-state/ON-state (Curve c), OFF-state/OFF-state (Curve d), one row before and after the measured OFF-state pixel. At the peak wavelength 530 nm, the reflectance varies from approximately 4.5% to 5.5% (a range of 1%).

Figure 9B:
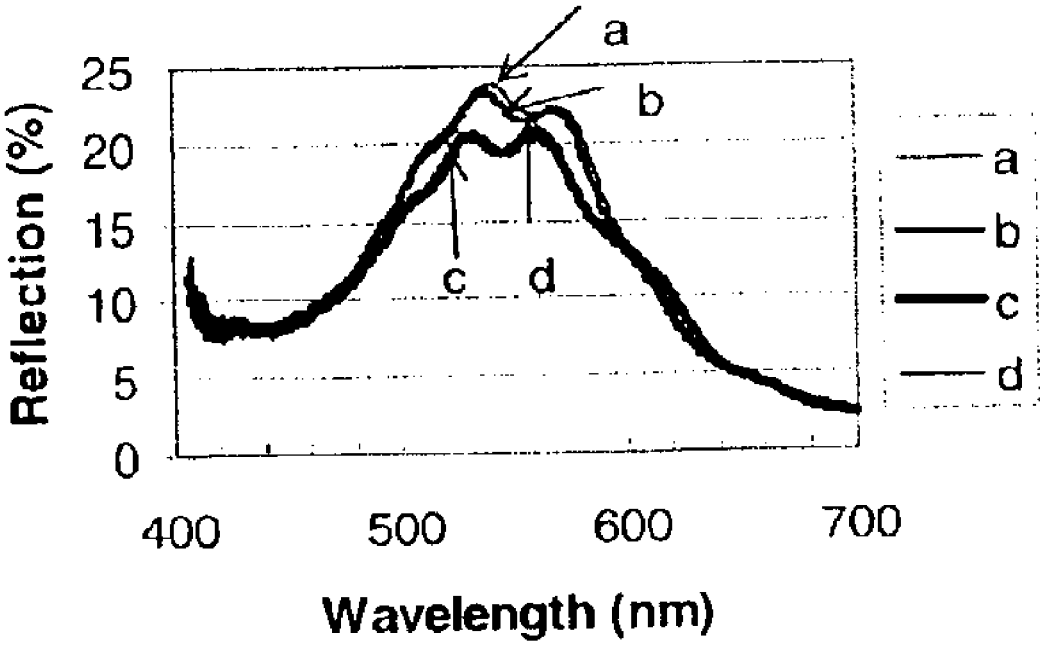

FIG. 9B shows four curves of reflectance as a function of wavelength for an ON-state (or bright state) pixel of a cholesteric liquid crystal display, corresponding to the same four possible data pattern combinations as in FIG. 9A. At the peak wavelength 530 nm, the reflectance varies from approximately 18% to 24% (a range of 6%). Although the variations in reflectance value appear small, even small variations, especially in a dark state, result in noticeable defects.

Figure 10A:
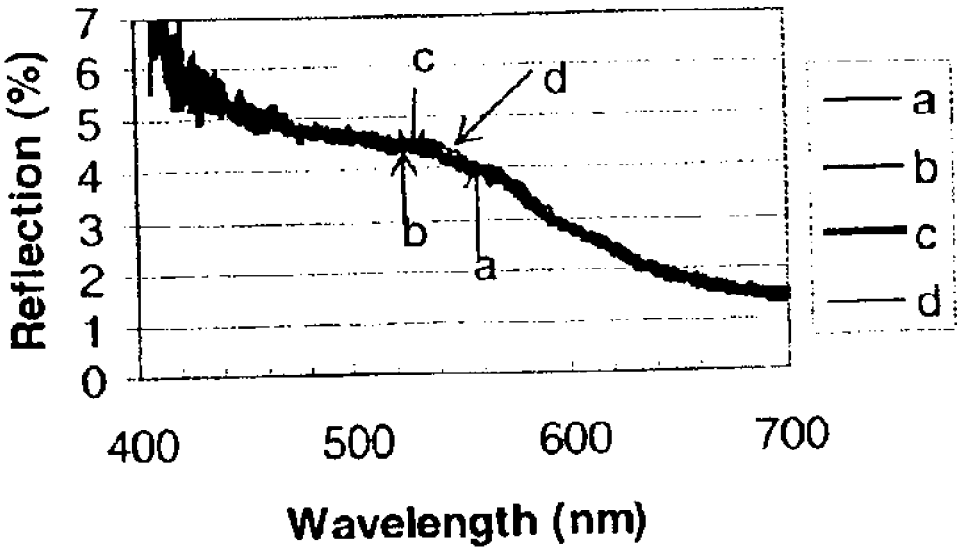
FIGS. 10A, 10B are experimental data showing reduced data dependency of an ON-state and an OFF-state, respectively, in drive scheme according to the present invention using the waveforms shown in FIG. 8A.
Figure 10B:
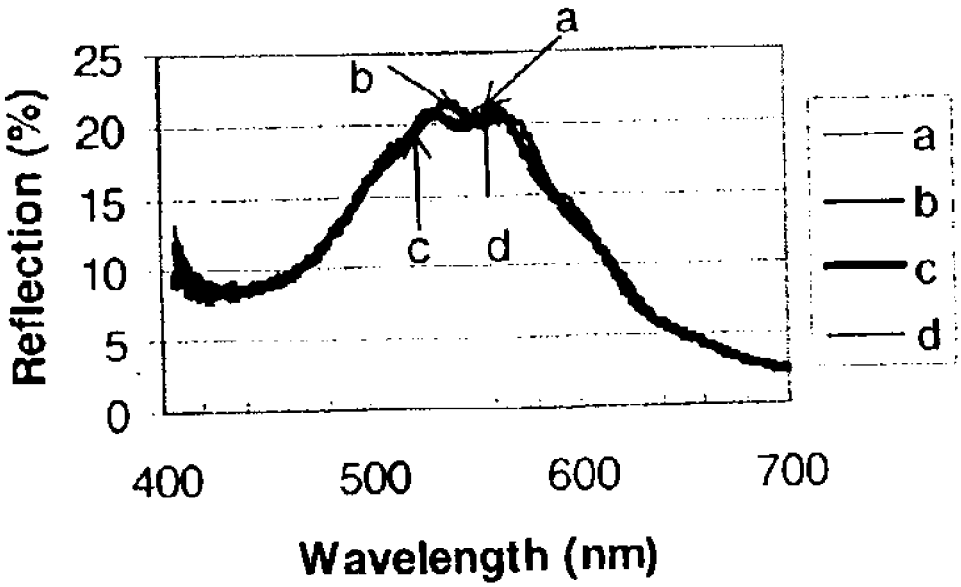

FIGS. 10A and 10B show data analogous to the data shown in FIGS. 9A and 9B, obtained with the improved drive scheme of the present invention. Both FIGS. 10A and 10B show that the variation of reflectance vs wavelength is reduced substantially compared to the variation shown in FIGS. 9A and 9B obtained with a prior art drive scheme. For example, the reflectance of the OFF-state at the peak wavelength of 530 nm varies from approximately 4.4% to 4.6% (a range of only 0.2%) as shown in FIG. 10A, and the reflectance of the ON-state at the wavelength of 530 nm changes from about 19% to 22% (a range of 3%). Thus, the improved drive scheme reduces the data pattern dependent defects for both dark (or OFF-state) and bright (or ON-state) states. It should be noted that the improved drive scheme can also reduce the data pattern dependency of any gray level state.

The invention has been described in detail with particular reference to certain preferred embodiments thereof, but it will be understood that variations and modifications can be effected within the spirit and scope of the invention. For example, the framing voltage pulses inserted between each successive selected pixel voltage pulse can also be applied to a three step dynamic drive scheme as disclosed in U.S. Pat. No. 5,748,277, a four step and five step dynamic drive scheme as disclosed in U.S. Pat. No. 6,154,190. The relevant dynamic drive scheme can be implemented with uni-polar row and column voltage drivers, and it can be implemented with two-voltage level or multi-voltage level row and column drivers. The framing voltage pulses also benefit other fast drive schemes that may not fall into the category of a dynamic drive scheme, especially those offering a writing speed at less than 2 ms per row. Though the cholesteric liquid crystal display in the above experiment was used as a reflective display, it can also be used as a transmissive display.

PARTS LIST

10 display
15 substrate
20 first patterned conductors
22 planar state
24 focal conic state
25 homeotropic state
26 incident light
27 transmitted light
28 reflected light
30 polymer dispersed cholesteric layer
40 second patterned conductors
100 voltage source
120 control electronics
122 duty cycle controller
124 phase controller
126 frequency controller
132 column pulses
136 row pulses
150 display
152 row driver
154 column driver

162 column electrodes
164 row electrodes
200 voltage pulse on selected rows
205 voltage pulse on non-selected rows
207 row voltage pulse in the frame period $T_{f1}$
208 row voltage pulse in the frame period $T_{f2}$
220 column voltage pulse for on-state
225 column voltage pulse in the frame period $T_{f1}$
226 column voltage pulse in the frame period $T_{f2}$
240 column voltage pulse for off-state
260 pixel voltage pulse on selected rows for on-state
265 pixel voltage pulse on non-selected rows for on-state
280 pixel voltage pulse on selected rows for off-state
285 pixel voltage pulse on non-selected rows for off-state
295 pixel voltage pulse in the frame period $T_{f1}$
296 pixel voltage pulse in the frame period $T_{f2}$
310 column waveform $V_{Con1}$ having on-state data for the second row
320 pixel waveform $V_{Pon1}$ having on-state data for the second row
330 column waveform $V_{Con2}$ having on-state data for the second row
340 pixel waveform $V_{Pon2}$ having on-state data for the second row
350 column waveform $V_{Con3}$ having on-state data for the second row
360 pixel waveform $V_{Pon3}$ having on-state data for the second row
370 column waveform $V_{Con4}$ having on-state data for the second row
380 pixel waveform $V_{Pon4}$ having on-state data for the second row
390 row waveform $V_{R2}$ on the second row
410 column waveform $V_{Coff1}$ having off-state data for the second row
420 pixel waveform $V_{Poff1}$ having off-state data for the second row
430 column waveform $V_{Coff2}$ having off-state data for the second row
440 pixel waveform $V_{Poff2}$ having off-state data for the second row
450 column waveform $V_{Coff3}$ having off-state data for the second row
460 pixel waveform $V_{Poff3}$ having off-state data for the second row
470 column waveform $V_{Coff4}$ having off-state data for the second row
480 pixel waveform $V_{Poff4}$ having off-state data for the second row
510 column waveform $\overline{V}_{Con1}$ having on-state data for the second row
512 column waveform $\overline{V}_{Con12}$ having on-state data for the second row
513 column waveform $\overline{V}_{Con13}$ having on-state data for the second row
520 pixel waveform $\overline{V}_{Pon1}$ having on-state data for the second row
522 pixel waveform $\overline{V}_{Pon12}$ having on-state data for the second row
523 pixel waveform $\overline{V}_{Pon13}$ having on-state data for the second row
530 column waveform $\overline{V}_{Con2}$ having on-state data for the second row
532 column waveform $\overline{V}_{Con22}$ having on-state data for the second row
533 column waveform $\overline{V}_{Con23}$ having on-state data for the second row
540 pixel waveform $\overline{V}_{Pon2}$ having on-state data for the second row
542 pixel waveform $\overline{V}_{Pon22}$ having on-state data for the second row
543 pixel waveform $\overline{V}_{Pon23}$ having on-state data for the second row
550 column waveform $\overline{V}_{Con3}$ having on-state data for the second row
552 column waveform $\overline{V}_{Con32}$ having on-state data for the second row
553 column waveform $\overline{V}_{Con33}$ having on-state data for the second row
560 pixel waveform $\overline{V}_{Pon3}$ having on-state data for the second row
562 pixel waveform $\overline{V}_{Pon32}$ having on-state data for the second row
563 pixel waveform $\overline{V}_{Pon33}$ having on-state data for the second row
570 column waveform $\overline{V}_{Con4}$ having on-state data for the second row
572 column waveform $\overline{V}_{Con42}$ having on-state data for the second row
573 column waveform $\overline{V}_{Con43}$ having on-state data for the second row
580 pixel waveform $\overline{V}_{Pon4}$ having on-state data for the second row
582 pixel waveform $\overline{V}_{Pon42}$ having on-state data for the second row
583 pixel waveform $\overline{V}_{Pon43}$ having on-state data for the second row
590 row waveform $\overline{V}_{R2}$ on the second row
593 row waveform $\overline{V}_{R23}$ on the second row
610 column waveform $\overline{V}_{Coff1}$ having off-state data for the second row
612 column waveform $\overline{V}_{Coff2}$ having off-state data for the second row
613 column waveform $\overline{V}_{Coff13}$ having off-state data for the second row
620 pixel waveform $\overline{V}_{Poff1}$ having off-state data for the second row
622 pixel waveform $\overline{V}_{Poff2}$ having off-state data for the second row
623 pixel waveform $\overline{V}_{Poff13}$ having off-state data for the second row
630 column waveform $\overline{V}_{Coff2}$ having off-state data for the second row
632 column waveform $\overline{V}_{Coff22}$ having off-state data for the second row
633 column waveform $\overline{V}_{Coff23}$ having off-state data for the second row
640 pixel waveform $\overline{V}_{Poff2}$ having off-state data for the second row
642 pixel waveform $\overline{V}_{Poff22}$ having off-state data for the second row
643 pixel waveform $\overline{V}_{Poff23}$ having off-state data for the second row
650 column waveform $\overline{V}_{Coff3}$ having off-state data for the second row
652 column waveform $\overline{V}_{Coff32}$ having off-state data for the second row
653 column waveform $\overline{V}_{Coff33}$ having off-state data for the second row
660 pixel waveform $\overline{V}_{Poff3}$ having off-state data for the second row
662 pixel waveform $\overline{V}_{Poff32}$ having off-state data for the second row
663 pixel waveform $\overline{V}_{Poff33}$ having off-state data for the second row

670 column waveform $\overline{V}_{Coff4}$ having off-state data for the second row

672 column waveform $\overline{V}_{Coff42}$ having off-state data for the second row

673 column waveform $\overline{V}_{Coff43}$ having off-state data for the second row

680 pixel waveform $\overline{V}_{Poff4}$ having off-state data for the second row

682 pixel waveform $\overline{V}_{Poff42}$ having off-state data for the second row

683 pixel waveform $\overline{V}_{Poff43}$ having off-state data for the second row t time $t_{on1}$ effective selection time corresponding to pixel waveform $V_{Pon1}$ $t_{on2}$ effective selection time corresponding to pixel waveform $V_{Pon2}$ $t_{on3}$ effective selection time corresponding to pixel waveform $V_{Pon3}$ $t_{on4}$ effective selection time corresponding to pixel waveform $V_{Pon4}$ $t_{off1}$ effective selection time corresponding to pixel waveform $V_{Poff1}$ $t_{off2}$ effective selection time corresponding to pixel waveform $V_{Poff2}$ $t_{off3}$ effective selection time corresponding to pixel waveform $V_{Poff3}$ $t_{off4}$ effective selection time corresponding to pixel waveform $V_{Poff4}$ $t_{on7}$ effective selection time corresponding to pixel waveforms $\overline{V}_{Pon1}$, $\overline{V}_{Pon2}$, $\overline{V}_{Pon3}$, and $\overline{V}_{Pon4}$ $t_{off7}$ effective selection time corresponding to pixel waveforms $\overline{V}_{Poff1}$, $\overline{V}_{Poff2}$, $\overline{V}_{Poff3}$, and $\overline{V}_{Poff4}$ $t_{on9}$ effective selection time corresponding to pixel waveforms $\overline{V}_{Pon12}$, $\overline{V}_{Pon22}$, $\overline{V}_{Pon32}$, $\overline{V}_{Pon42}$, $\overline{V}_{Pon13}$, $\overline{V}_{Pon23}$, $\overline{V}_{Pon33}$, and $\overline{V}_{Pon43}$ $t_{off9}$ effective selection time corresponding to pixel waveforms $\overline{V}_{Poff12}$, $\overline{V}_{Poff22}$, $\overline{V}_{Poff32}$, $\overline{V}_{Poff42}$, $\overline{V}_{Poff13}$, $\overline{V}_{Poff23}$, $\overline{V}_{Poff33}$, and $\overline{V}_{Poff43}$

T1, T2, T3 writing period $T_{f1}$, $T_{f2}$ frame period

Tc a duration including a period of T2 and a 50% period before and after T2

U maximum voltage $V_{Rs}$ row voltage pulse on a selected row $V_{Rns}$ row voltage pulse on a non-selected row $V_{Con}$ column voltage pulse for on-state $V_{Coff}$ column voltage pulse for off-state $V_{Pson}$ pixel voltage on selected rows when the column voltage is $V_{Con}$ $V_{Psoff}$ pixel voltage on selected rows when the column voltage is $V_{Coff}$ $V_{Pnson}$ pixel voltage on non-selected rows when the column voltage is $V_{Con}$ $V_{Pnsoff}$ pixel voltage on non-selected rows when the column voltage is $V_{Coff}$ $V_1$ voltage below which states of cholesteric liquid crystals do not change $V_2$, $V_3$ voltages at which cholesteric liquid crystals are switched into focal conic state $V_4$ voltage above which cholesteric liquid crystals are switched into planar state after the voltage is turned off quickly

What is claimed is:

1. An improved drive scheme for driving the pixels of a passive matrix liquid crystal display having row and column electrodes, the drive scheme including a selection step, the selection step including applying row and column waveforms to the display to generate selected pixel voltage pulses in a selected row and to generate non selected pixel voltage pulses in non selected rows, the selection step having an effective selection time that depends on the preceding and following nonselected pixel voltages, wherein the improvement comprises:

inserting a framing voltage pulse between each successive selected pixel voltage pulse such that the effective selection time is independent of the preceding and following nonselected pixel voltages, whereby data pattern dependent defects in a displayed image are eliminated.

2. The improved drive scheme claimed in claim 1, wherein the display is a cholesteric liquid crystal display and the drive scheme includes a preparation step prior to the selection step and an evolution step following the selection step.

3. The improved drive scheme claimed in claim 2, wherein the drive scheme is a three step dynamic drive scheme.

4. The improved drive scheme claimed in claim 2, wherein the drive scheme is a four step dynamic drive scheme.

5. The improved drive scheme claimed in claim 2, wherein the drive scheme is a five step dynamic drive scheme.

6. The improved drive scheme claimed in claim 2, wherein the drive scheme is a unipolar dynamic drive scheme.

7. The improved drive scheme claimed in claim 2, wherein the drive scheme is a two voltage level dynamic drive scheme.

8. The improved drive scheme claimed in claim 2, wherein the drive scheme is a multi-voltage level dynamic drive scheme.

9. The improved drive scheme claimed in claim 1, wherein the display is a reflective display.

10. The improved drive scheme claimed in claim 1, wherein the display is a transmissive display.

11. The improved drive scheme claimed in claim 1, wherein the drive scheme includes ON-state effective selection time and an OFF-state effective selection time.

12. The improved drive scheme claimed in claim 11, wherein the ON-state effective selection time and an OFF-state effective selection time are equal.

13. The improved drive scheme claimed in claim 11, wherein the ON-state effective selection time and an OFF-state effective selection time are not equal.

14. The improved drive scheme claimed in claim 1, wherein the local average effective selection voltages are independent of the preceding and following nonselected pixel voltages.

15. The improved drive scheme claimed in claim 14, wherein the local average effective selection voltages are zero.

* * * * *